US006084386A

United States Patent [19]

Takahashi et al.

[11] Patent Number: 6,084,386

[45] Date of Patent: Jul. 4, 2000

[54] VOLTAGE GENERATION CIRCUIT CAPABLE OF SUPPLYING STABLE POWER SUPPLY VOLTAGE TO LOAD OPERATING IN RESPONSE TO TIMING SIGNAL

[75] Inventors: Mitsue Takahashi; Tadaaki Yamauchi; Mitsuya Kinoshita, all of Hyogo, Japan

[73] Assignee: Mitsubishi Denki Kabushiki Kaisha, Tokyo, Japan

[21] Appl. No.: 09/362,665

[22] Filed: Jul. 29, 1999

[30] Foreign Application Priority Data

Feb. 5, 1999 [JP] Japan ..... 11-028447

[51] Int. Cl.[7] ..... G05F 1/40; G05F 1/56

[52] U.S. Cl. ..... 323/273; 323/282

[58] Field of Search ..... 323/268, 270, 323/273, 274, 282, 284

[56] References Cited

U.S. PATENT DOCUMENTS 5,321,653 6/1994 Suh et al. .
5,612,920 3/1997 Tomishima .
5,694,028 12/1997 Salmonson et al. ..... 323/273
5,764,041 6/1998 Pulvirenti et al. ..... 323/282
5,828,206 10/1998 Hosono et al. ..... 323/273

FOREIGN PATENT DOCUMENTS 6-103793 4/1994 Japan .
6-131869 5/1994 Japan .
10-27026 1/1998 Japan .

*Primary Examiner*—Matthew Nguyen
*Attorney, Agent, or Firm*—McDermott, Will & Emery

[57] ABSTRACT

A voltage generation circuit includes a voltage comparing circuit to compare a reference voltage signal Vi and an internal power supply voltage Vcc and a current supply transistor to supply current based on the output voltage of the voltage comparing circuit and maintain Vcc. The voltage generation circuit also includes a reference voltage signal generation circuit which responds to a control signal ACT activated for a prescribed time period prior to the operation timing of a load and sets Vi=Vref when control signal ACT is inactive and Vi=Vref+ΔV when control signal ACT is active.

18 Claims, 13 Drawing Sheets

VOLTAGE GENERATION CIRCUIT CAPABLE OF SUPPLYING STABLE POWER SUPPLY VOLTAGE TO LOAD OPERATING IN RESPONSE TO TIMING SIGNAL

BACKGROUND OF THE INVENTION

1. Field of the Invention

The present invention relates generally to voltage generation circuits, and more specifically, to a voltage generation circuit capable of supplying a stable power supply voltage to a load operating in response to a timing signal applied from an external element, such as a sense amplifier in a semiconductor memory device.

2. Description of the Background Art

As the miniaturization has proceeded to meet the demand for semiconductor memory devices with increased capacity, the breakdown voltage of the internal circuitry of semiconductor devices has been lowered. There has been a demand in the market for a semiconductor memory device with power consumption reduced by lowering the operation voltage of the semiconductor memory device for example in connection with its application to portable equipment. To cope with this situation, the semiconductor memory device includes an internal power supply circuit and uses an appropriate internal power supply voltage obtained by lowering an external power supply voltage VCE of 5 V or 3.3 V for example to 2.5 V or 2.0 V.

Each of sense amplifier circuits included in a semiconductor memory device amplifies a very small voltage difference between bit lines to which memory cell data is read out, and high speed performance is necessary for the amplifying operation. The sense amplifier circuits generally operate by internal power supply voltage Vcc from such a power supply circuit provided inside.

In a semiconductor memory device, data in all the memory cells connected to the identical word line must be read out onto a bit line pair for each row selecting operation, a large number of sense amplifier circuits operate at the same time. A large amount of charges is supplied for a short period of time accordingly, when the sense amplifier circuits operate, and the voltage of a Vcc line supplying a power supply voltage to the sense amplifier circuits is temporarily lowered. This prevents a very small voltage difference generated between the lines of a bit line pair from being amplified fast, which results in a reduced operation speed.

There is a demand for an internal power supply voltage generation circuit which can supply stable internal power supply voltage Vcc to a load such as a sense amplifier which abruptly consumes a large amount of charges.

FIG. 19 is a schematic block diagram of a conventional internal power supply voltage generation circuit 500 used for this purpose by way of illustration.

Referring to FIG. 19, internal power supply voltage generation circuit 500 supplies internal power supply voltage Vcc to a load (sense amplifier) 517 by an internal power supply line 515.

A control target voltage for internal power supply voltage Vcc is provided by a prescribed DC voltage Vref1. Internal power supply generation circuit 500 includes a voltage comparing circuit 501 to generate an output voltage Vo corresponding to the difference between internal power supply voltage Vcc and Vref1 (Vcc−Vref1) and a current supply transistor 505 which receives output voltage Vo at its gate to connect an external power supply line 511 supplying external power supply voltage VCE and internal power supply line 515.

A current mirror circuit amplifier is typically used for voltage comparing circuit 501. External power supply voltage VCE and a ground voltage Vss are applied through a power supply switch 502.

Internal power supply voltage generation circuit 500 turns on current supply transistor 505 according to the output voltage Vo of voltage comparing circuit 501 when internal power supply voltage Vcc is lower than Vref1 and keeps internal power supply voltage Vcc at a constant level by supplying current Ic from external power supply line 511 to internal power supply line 515.

In internal power supply voltage generation circuit 500, however, during the actual period since internal power supply voltage Vcc is lowered until current supply transistor 505 is turned on, prescribed control delay corresponding to the response time of voltage comparing circuit 501 is present. This control delay is disadvantageous for example when a plurality of loads such as sense amplifiers operate in parallel in a short period of time in a semiconductor memory device.

FIG. 20 is a schematic diagram for use in illustration of a problem associated with internal power supply voltage generation circuit 500 when large current is consumed by a load in a short period of time.

Referring to FIG. 20, Vcc" is a waveform representing the fluctuation of internal power supply voltage Vcc when no feedback control is performed.

At time t1, the load is activated and current is consumed, which temporarily lowers internal power supply voltage Vcc.

In this case, if internal power supply voltage generation circuit 500 is operated, and a time lag Δt exists until the lowering of internal power supply voltage Vcc is actually reflected on output Vo to voltage comparing circuit 501, current supply transistor 505 will not conduct during the period of Δt, and therefore Vcc decreases similarly to Vcc'.

Then, at time t2 after time lag Δt corresponding to the response time of voltage comparing circuit 501 since time t1, comparison output voltage Vo starts to be lowered, which gradually turns on current supply transistor 505, and power supply current Ic is allowed to flow from external power supply line 511 to internal power supply line 515. This power supply current Ic allows internal power supply voltage Vcc to regain the level of control target voltage Vref1.

After internal power supply voltage Vcc returns to the level of reference voltage Vref1, similar response time is present in voltage comparing circuit 501, therefore current supply transistor 505 will not be turned off soon, and internal power supply voltage Vcc is raised to a level higher than Vref1. If the response time Δt of voltage comparing circuit 501 is large, internal power supply voltage Vcc could be sometimes raised to too high a level in comparison with Vref1 and in such a case, a circuit to lower internal power supply voltage Vcc should be separately provided.

Thus, if the load abruptly consumes large current, internal power supply voltage Vcc cannot be stably supplied simply by performing feedback control of internal power supply voltage Vcc by a voltage comparing circuit such as current mirror amplifier which must take the response time into consideration.

Therefore, an internal power supply voltage generation circuit to stably supply an operation power supply voltage to a load whose operation timing is previously known is disclosed by Japanese Patent Laying-Open No. 10-27026.

FIG. 21 is a circuit diagram showing the general structure of an internal power supply voltage generation circuit 510 disclosed by this document.

Referring to FIG. 21, internal power supply voltage generation circuit 510 supplies operation voltage VCI to a load 512.

Operation voltage VCI is provided to a voltage comparing circuit 511 as a feedback voltage signal DCI through a transistor Q2. Voltage comparing circuit 511 outputs an output voltage corresponding to the voltage difference between feedback voltage signal DCI and a reference voltage Vref2 to a node S1. A current supply transistor Q1 supplies current from external power supply voltage VCE to load 512 when operation voltage VCI is lowered in response to the voltage at node S1 and functions to keep operation voltage VCI constant.

In internal power supply voltage generation circuit 510, reference voltage Vref2 is generated by a reference voltage generation circuit 513. Reference voltage generation circuit 513 includes a current source I2 and resistors R23 and R24 connected in series between the external power supply and the ground line. To both ends of resistor R23, the source and drain of a transistor Q8 are connected. A control signal S8 is applied to the gate of transistor Q8 and resistor R23 is short-circuited while transistor Q8 is on by control signal S8. A node N6 is connected between low current source 12 and resistor R23. The voltage generated at node N6 is applied to voltage comparing circuit 511 as reference voltage Vref2.

With reference voltage generation circuit 513 having this configuration, reference voltage Vref2 can be changed into pulse-wise according to control signal S8.

More specifically, if the operation timing of load 512 is previously known, control signal S8 can be controlled prior to an activation timing of load 512 to set reference voltage Vref2 to a value higher than normal, so that current supply transistor Q1 can be turned on in coincidence with the operation timing of load 512.

Thus, even using voltage comparing circuit 511 involving the response delay, effective control can be performed to a load which consumes large current in a short period of time if the operation timing of the circuit is previously known, and by controlling operation voltage VCI to be stable, the problem described in conjunction with FIG. 20 is addressed.

Reference voltage generation circuit 513 included in internal power supply voltage generation circuit 510 adjusts the reference voltage within the range from the ground voltage to external power supply voltage VCE by the presence/absence of a short circuit of a resistor.

However, in reference voltage generation circuit 513 having this configuration, there is current allowed to flow through the path of external power supply VCE—current source I2—resistor R23—resistor R24—ground line Vss, current is wasted. A relatively large number of circuit elements including resistors and transistors are necessary, which is disadvantageous in terms of layout. These problems could pose further potential shortcomings since semiconductor memory devices will be probably increased in scale in the future.

In addition, in reference voltage generation circuit 513, when the voltage difference between the reference value of operation voltage VCI and external power supply voltage VCE is small, the pulse amplitude which can be generated by control signal S8 could be small, which could impair improvement in responsiveness. If feedback voltage signal DCI is generated through a voltage dividing circuit to cope with this end, the described disadvantage associated with the layout is further amplified.

In view of the future development of semiconductor memory devices, the operation voltage will be necessarily further lowered and external power supply voltage VCE and the operation voltage VCI of the internal circuit will be further lowered. Then, the above described problem will be more serious in this context.

SUMMARY OF THE INVENTION

One object of the present invention is to provide a voltage generation circuit capable of supplying an operation power supply voltage with sufficient responsiveness to a load operating in response to a timing signal and consuming a large amount of current in a short period of time.

Briefly stated, according to the present invention, a voltage generation circuit to supply an operation power supply voltage to a load which starts an active period in which current is consumed in response to a control signal includes a first power supply line, a second power supply line, a reference voltage generation circuit, a voltage comparing circuit, and a current supply circuit.

The first power supply line supplies the load with an operation power supply voltage.

The second power supply line is supplied with a second voltage higher than a first voltage which is a control target voltage for the operation power supply voltage.

The reference voltage signal generation circuit sets the level of the reference voltage signal to a level higher than the level of the second voltage in an active period of the load and sets the level of the reference voltage signal to the level of the first voltage in response to a control signal.

The voltage comparing circuit compares the voltage levels of the reference voltage signal and the first power supply line to output a deviation voltage signal.

The current supply circuit supplies current to the first power supply line from the second power supply line based on the level of the deviation voltage signal.

According to another aspect of the present invention, a voltage generation circuit to supply an operation power supply voltage to a load which starts an active period to consume current in response to a control signal includes a first power supply line, a second power supply line, a voltage comparing circuit, a control node, a current supply circuit, and a switching control circuit.

The first power supply line supplies the load with an operation power supply voltage.

The second power supply line is supplied with a second voltage higher than a first voltage which is a control target voltage for the operation power supply voltage.

The voltage comparing circuit compares the voltage levels of the first voltage and the first power supply line to output a deviation voltage signal.

The current supply circuit operates in response to the voltage level of the control node to supply current from the second power supply line to the first power supply line.

The switch control circuit connects the control node and the voltage comparing circuit in an inactive period of the load, disconnects the control node and the voltage comparing circuit in an active period of the load and transmits to the control node a third voltage which permits the current supply circuit to operate.

According to another aspect of the present invention, a voltage generation circuit to supply an operation power supply voltage to a load which starts an active period to consume current in response to a control signal includes a first power supply line, a second power supply line, a voltage comparing circuit, a control node, a current supply circuit, a third power supply line, a first switch circuit, and a second switch circuit.

The first power supply line supplies the load with an operation power supply voltage.

The second power supply line is supplied with a second voltage higher than a first voltage which is a control target voltage for the operation power supply voltage.

The voltage comparing circuit receives the operation voltage supplied from the second power supply line and compares the voltage levels of the first voltage and the first power supply line to output a deviation voltage signal to the control node.

The current supply circuit operates in response to the voltage of the control node to supply current from the second power supply line to the first power supply line.

The third power supply line supplies a prescribed voltage which permits the current supply circuit to operate when the voltage is applied to the control node.

The first switch circuit connects the control node and the third power supply line in an active period of the load.

The second switch circuit is provided between the second power supply line and the voltage comparing circuit to disconnect them in an active period of the load.

Therefore, a main advantage of the present invention lies in that the control responsiveness of the internal power supply voltage can be sufficiently secured if the difference between the external power supply voltage and the operation voltage of the internal circuit decreases as the device comes to operate with lower voltage, because the reference voltage signal is changed stepwise by amounts of boosted voltage free from restriction by the external power supply voltage in response to the start of an active period of the load.

In addition, since the voltage comparing circuit and the current supply circuit are disconnected and the current supply circuit is forcibly turned on in response to the start of an active period of the load, the timing of starting operating the load and the timing of turning on the current supply circuit can be easily matched, so that the internal power supply voltage can be stably controlled.

Furthermore, since the current supply circuit is forcibly turned on and supply of driving current to the voltage comparing circuit is stopped in response to an activation of the load, so that the internal power supply voltage can be stably controlled and the power consumption can be reduced.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
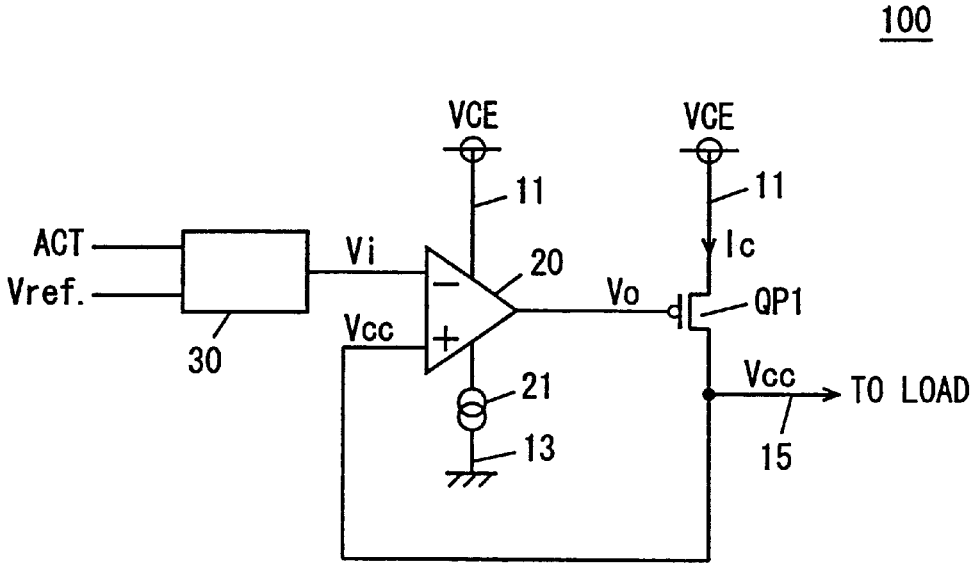
FIG. 1 is a schematic block diagram for use in illustration of the general configuration of an internal power supply voltage generation circuit 100 according to a first embodiment of the invention.

Embodiments of the present invention will be now described in conjunction with the accompanying drawings, in which the same reference characters refer to the same or corresponding portions.

First Embodiment

FIG. 1 is a schematic block diagram for use in illustration of the general configuration of an internal power supply generation circuit 100 according to a first embodiment of the present invention.

Referring to FIG. 1, internal power supply voltage generation circuit 100 supplies a load with an internal power supply voltage Vcc. Internal power supply voltage generation circuit 100 includes a voltage comparing circuit 20 to output to a control node an output voltage according to the voltage difference between an internal power supply voltage Vcc and a reference voltage signal Vi and a current supply transistor QP1 to supply a power supply current Ic from external power supply line 11 supplying an external power supply voltage VCE to an internal power supply line 15 supplying internal power supply voltage Vcc in response to voltage Vo at the control node.

Internal power supply voltage generation circuit 100 further includes a reference voltage signal generation circuit 30 which receives a load activation timing signal ACT activated in response to the operation timing of the load and prescribed DC voltage Vref which is a control target voltage for internal power supply voltage Vcc and generates reference voltage signal Vi.

In internal power supply voltage generation circuit 100 according to the first embodiment of the present invention, the voltage level of reference voltage signal Vi is changed pulse-wise in response to a load activation timing signal ACT, while a voltage obtained by boosting Vref is generated as Vi in an activation period of the operation timing of the load, in other words in an activation period of load activation timing signal ACT.

More specifically, current supply transistor QP1 is sufficiently turned on in conformity with the operation timing of the load, so that fluctuations in internal power supply voltage Vcc can be restrained and a voltage can be stably supplied.

Note that in the following description of embodiments, a sense amplifier is listed as a typical load whose operation timing is known, supplied with the operation voltage by an internal power supply voltage generation circuit and consuming a large amount of current for a short period of time.

Figure 2:
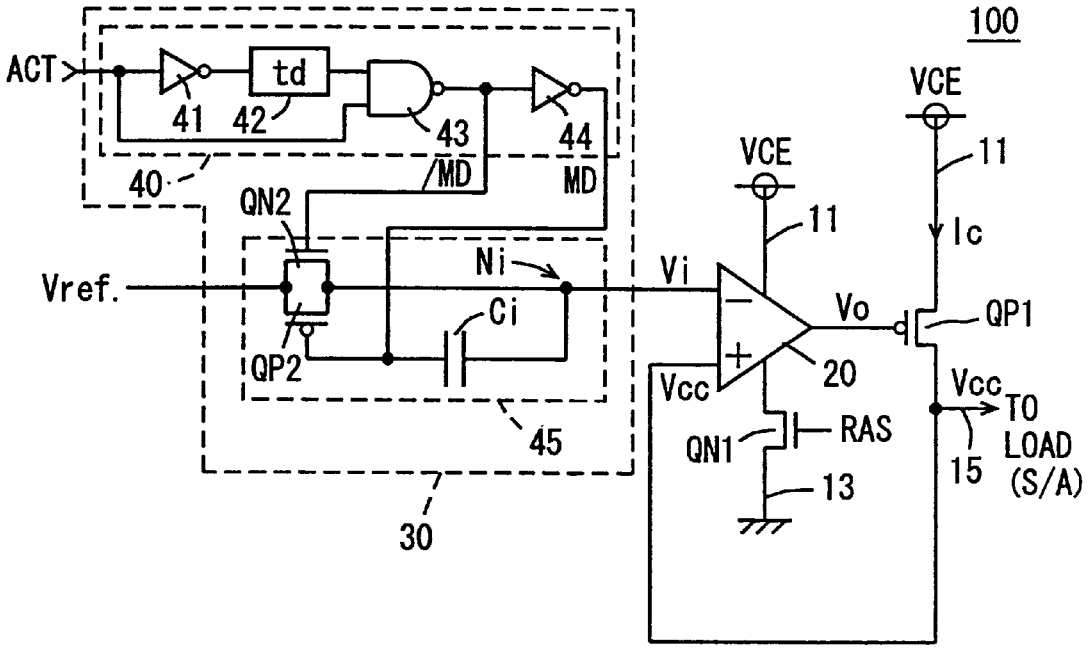
FIG. 2 is a circuit diagram showing the specific configuration of internal power supply voltage generation circuit 100.

FIG. 2 is a circuit diagram of the specific configuration of an internal power supply voltage 100. In FIG. 2, the configuration of a reference voltage generation circuit 30 will be detailed.

Referring to FIG. 2, reference voltage generation circuit 30 includes a mode change signal generation circuit 40 and a Vi boosting circuit 45. Mode change signal generation circuit 40 receives a load activation timing signal ACT and generates a mode change signal MD and the inverse /MD. Detailed timings will be described later, and load activation timing signal ACT is activated in response to an activation of a sense amplifier as a load to rise from an "L" level to an "H" level.

Mode change signal generation circuit 40 includes an inverter 41 to invert signal ACT, a delay circuit 42 to delay the output of inverter 41 by delay time td for output, a logic gate 43 which outputs a NAND of the output of delay circuit 42 and signal ACT, and an inverter 44 to invert the output of logic gate 43.

A pulse-wise voltage signal, mode change signal MD activated during period td in a rising timing of signal ACT is generated at the output node of inverter 44.

Delay circuit 42 includes multiple stages of inverters, and the number of the stages can be changed to adjust delay time td. The inverted signal /MD is similarly generated and activated (to an "L" level) during this period td.

Mode change signal MD and the inverted signal /MD are provided to Vi boosting circuit 45. Vi boosting circuit 45 includes a node Ni to output reference voltage signal Vi, an input node to receive voltage Vref, a P-type transistor QP2 which receives mode change signal MD at its gate and connects the input node and output node Ni, an N-type transistor QN2 which receives signal /MD at its gate and connects the input and output nodes, and a capacitor Ci connected between the gate of and transistor QP2 node Ni.

When mode change signal MD is in an inactive state (in an "L" level), transistors QN2 and QP2 both conduct, reference voltage signal Vi is set to the level of Vref and capacitor Ci is charged by voltage Vref.

Mode change signal MD is activated (to an "H" level) during prescribed period td in response to an activation of load activation timing signal ACT. At this time, transistors QN2 and QP2 are both turned off but reference voltage signal Vi corresponds to a voltage produced by adding a boosted voltage ΔV by the charged voltage of capacitor Ci to a voltage corresponding to the "H" level of signal MD. Boosted voltage ΔV can be essentially adjusted by the capacity value of capacitor Ci, and can be set irrespectively of external power supply voltage VCE.

Voltage comparing circuit 20 is connected between external power supply line 11 and ground line 15 through transistor QN1 receiving at its gate a signal RAS activated in an earlier timing than an activation of load activation timing signal ACT and receives current supply. This current drives voltage comparing circuit 20 and an output voltage Vo corresponding to the voltage difference between reference voltage signal Vi and internal power supply voltage Vcc is output to a node No.

By the feedback control of internal power supply voltage Vcc based on reference voltage signal Vi generated by reference voltage signal generation circuit 30 having the above configuration, current supply transistor QP1 can be turned on to supply power supply current Ic to internal power supply line 15 in the same timing as the start of the operation of the load even before the lowering of internal power supply voltage Vcc is detected by voltage comparing circuit 20, so that the level of an internal power supply voltage can be stably kept if a large amount of current is abruptly consumed by the load at the start of the operation. Reference voltage signal Vi can be boosted by ΔV without restriction by the level of external power supply voltage VCE, and therefore if the device comes to be operated at lower operation voltage and the difference between external power supply voltage VCE and control target voltage Vref for the operation voltage of the internal circuit is reduced, the control responsiveness of the internal power supply voltage can be sufficiently secured even with a compact control circuit.

Figure 3:
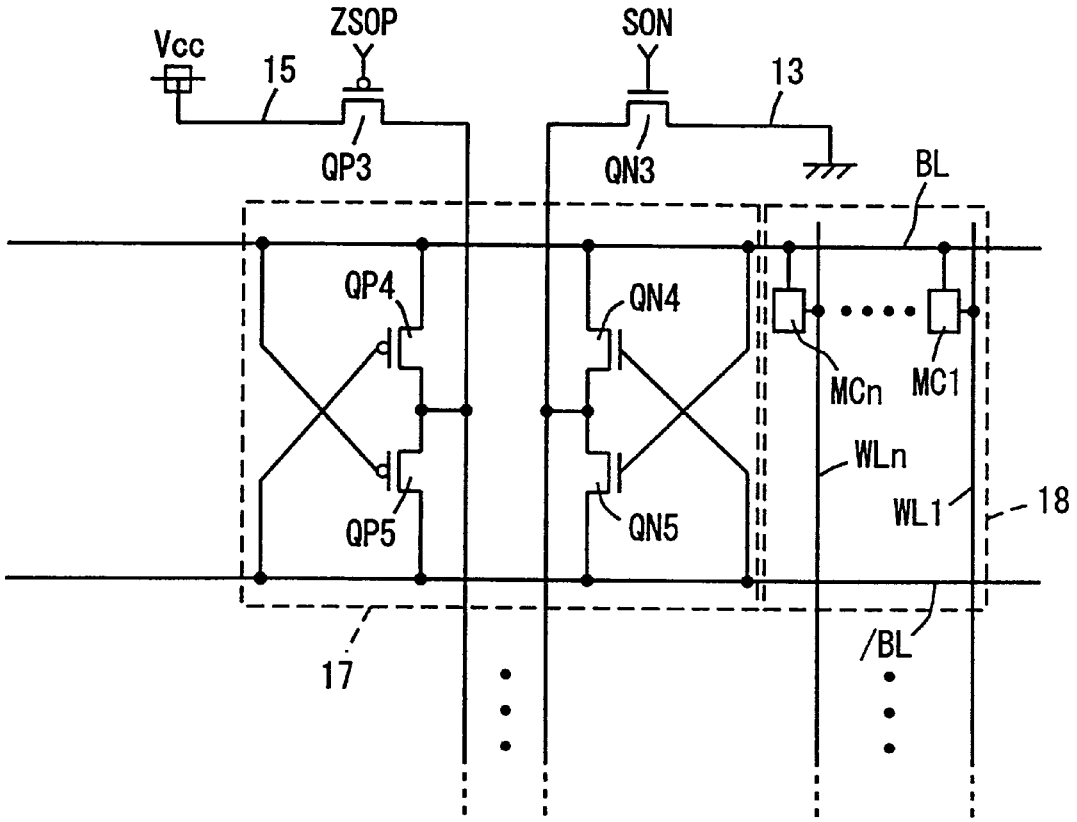
FIG. 3 is a circuit diagram for use in illustration of the configuration and operation of a sense amplifier 17 serving as a load for internal power supply voltage generation circuit 100.

FIG. 3 is a circuit diagram for use in illustration of the configuration and operation of sense amplifier 17 as the load of internal power supply voltage generation circuit 100.

Referring to FIG. 3, sense amplifier 17 is provided corresponding to a memory cell column 18. Memory cell column 18 includes memory cells MC1 to MCn and a bit line pair BL and /BL. Memory cells MC1 to MCn are connected to bit line BL1.

Sense amplifier 17 includes a P-type transistor QP5 to transmit voltage VCC corresponding to "H" level data to /BL when "L" level data is read out from a memory cell and an N-type transistor QN4 to transmit "L" level data to BL accordingly. Similarly, sense amplifier 17 includes an N-type transistor QN5 to transmit a voltage corresponding to "L" data to /BL when "H" level data is read out form a memory cell and a P-type transistor QP4 to transmit "H" level data to BL accordingly.

The sources of P-type transistors QP4 and QP5 are supplied with internal power supply voltage Vcc through a P-type transistor QP3 which receives a control signal ZSOP at its gate. Similarly, the source of N-type transistors QN4 and QN5 are supplied with ground voltage Vss through N-type transistor QN3 which receives a control signal SON at its gate.

A large number of memory cell columns are provided adjacent to one another in the direction orthogonal to bit line pairs and a sense amplifier is provided for each of the memory cell columns. Memory cell columns associated with the identical word line are activated at a time by a single row selecting operation, and therefore sense amplifiers provided corresponding to the memory cell columns are also supplied with an operation power supply voltage by common internal power supply line 15. Therefore, internal power supply line 15 is connected to a large number of sense amplifiers, which requests a large amount of current to be supplied for a short period of time.

Figure 4:
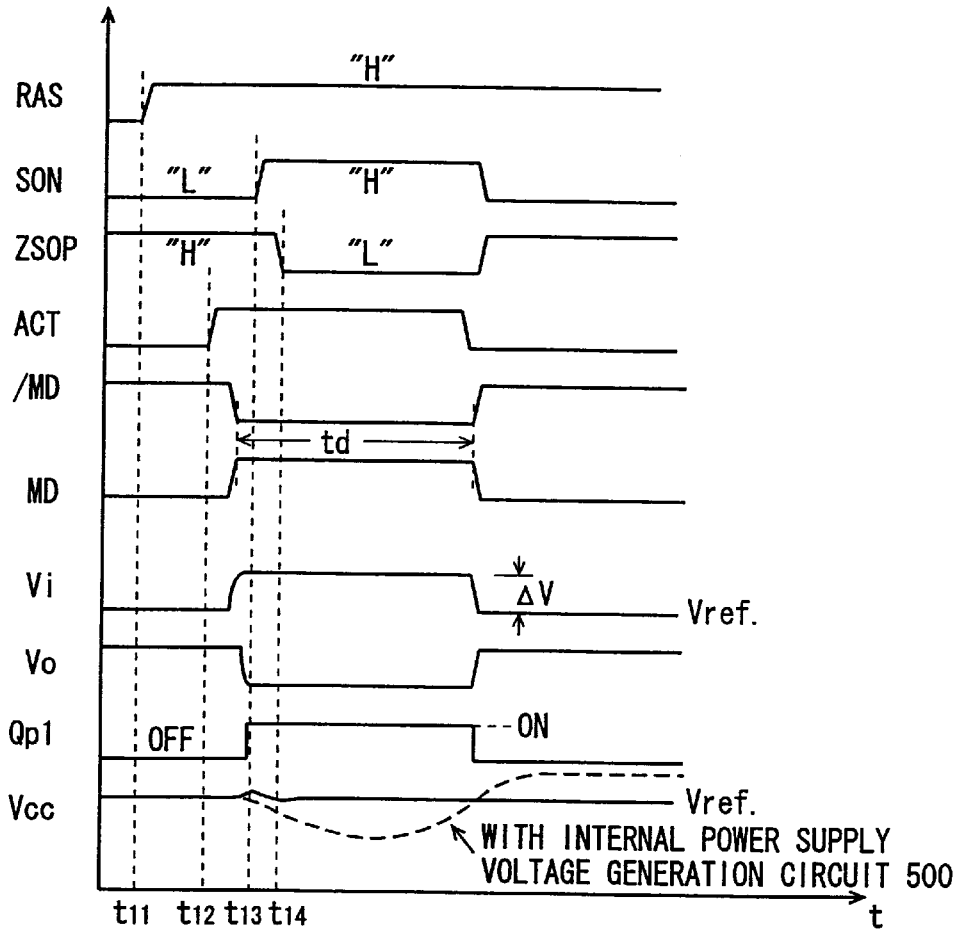
FIG. 4 is an operation waveform chart for use in illustration of the operation of internal power supply voltage generation circuit 100.

FIG. 4 is an operation waveform chart for use in illustration of the operation of internal power supply voltage generation circuit 100.

Referring to FIG. 4, at time t11, a control signal RAS to activate a row selecting operation is activated (into an "H" level) prior to an operation of a sense amplifier. After a prescribed period of time since the activation of control signal RAS, control signal SON to activate an N-type transistor in sense amplifier 17 for activating the sense amplifier is activated at time t13. Similarly, control signal ZSOP to activate a P-type transistor in sense amplifier 17 is activated at time t14.

Before activation of signals whose activation timings are known, load activation timing signal ACT is activated (into an "H" level) at time t12 in a timing earlier than the activation of the sense amplifier. The load activation timing signal may be a signal newly generated according to a rising timing of signal RAS described above or a bank activation signal or the like generally activated in a semiconductor memory device during the period after the activation of signal RAS before the activation of the sense amplifier may be used.

As described above, mode change signal generation circuit 40 activates mode change signal MD (into an "H" signal) during delay time td set by delay circuit 42 as load activation timing signal ACT is activated.

Reference voltage signal Vi is equal to Vref by the conduction of transistors QN2 andQP2 when mode change signal MD is in an inactive state ("L" level). During this period, capacitor Ci is charged, and when mode change signal MD is activated to turn off transistors QN2 and QP2, reference voltage signal Vi generated at node Ni is a voltage produced by boosting internal power supply reference voltage Vref by ΔV.

Accordingly, the output voltage Vo of voltage comparing circuit 20 is lowered stepwise, which turns on current supply transistor QP1. Thus, the load, i.e., the sense amplifier is activated and power supply current Ic can be supplied in the same timing in which a large amount of current is supplied from internal power supply line 15.

As described above, in internal power supply voltage generation circuit 100 according to the first embodiment, reference voltage signal Vi to be compared to internal power supply voltage Vcc in voltage comparing circuit 20 is changed by a boosted pulse whose boosting timing, period and amplitude are adjustable, so that power supply current Ic is supplied from an external power supply line by a current supply transistor in the same timing as the timing in which the load consumes current, and internal power supply voltage Vcc can be stably controlled.

Second Embodiment

In the first embodiment, the reference voltage to be compared to internal power supply voltage Vcc in voltage comparing circuit 20 is changed pulse-wise to timely turn on current supply transistor QP1 and secure the controllability of internal power supply voltage Vcc. In a second embodiment, the stability of internal power supply voltage Vcc is secured by forcibly and quickly turning on current supply transistor QP1 without providing such a circuit to change the reference voltage pulse-wise.

Figure 5:
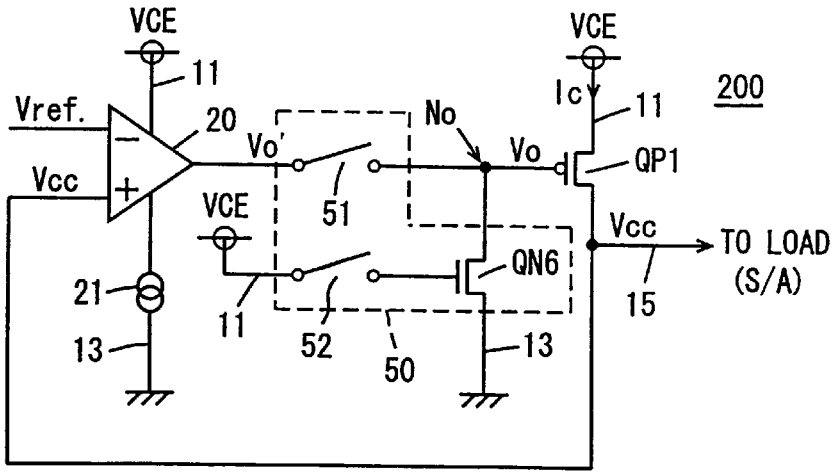
FIG. 5 is a schematic block diagram for use in illustration of an internal power supply voltage generation circuit 200 according to a second embodiment of the present invention.

FIG. 5 is a schematic block diagram for use in illustration of the general configuration of an internal power supply voltage generation circuit 200 according to the second embodiment of the present invention.

Referring to FIG. 5, internal power supply voltage generation circuit 200 includes a voltage comparing circuit 20 to output voltage Vo' based on the voltage difference between internal power supply voltage Vcc and control target voltage Vref for the internal power supply voltage, a control node No connected to the gate of current supply transistor QP1, a current supply transistor QP1 to supply power supply current Ic from an external power supply line 11 to an internal power supply line 15, and a control node switch circuit 50 to switch the connection of control node No.

Control node switch circuit 50 includes a switch 51 to connect voltage comparing circuit 20 and node No, an N-type transistor QN6 connected between control node No and a ground line 13 and a switch 52 to connect the gate of transistor QN6 and external power supply line 11.

Internal power supply voltage generation circuit 200 is different from internal power supply voltage generation circuit 100 according to the first embodiment in that a reference voltage to be compared to internal power supply voltage Vcc in voltage comparing circuit 20 is prescribed DC voltage Vref, which is a control target voltage for Vcc. Furthermore, voltage comparing circuit 20 and the gate of current supply transistor QP1 are not directly connected, and a voltage at control node No connected to the gate of current supply transistor QP1 is controlled by turning on/off switches 51 and 52.

One of switches 51 and 52 is selectively turned on. When switch 51 is on, voltage Vo at the control node is equal to the output voltage Vo' of voltage comparing circuit 20. Meanwhile, when switch 52 is on, the internal node and the output of voltage comparing circuit 20 are disconnected by tuning off switch 51, and voltage Vo at the control node is set to the level of ground voltage Vss by forcibly turning on transistor QN6.

Figure 6:
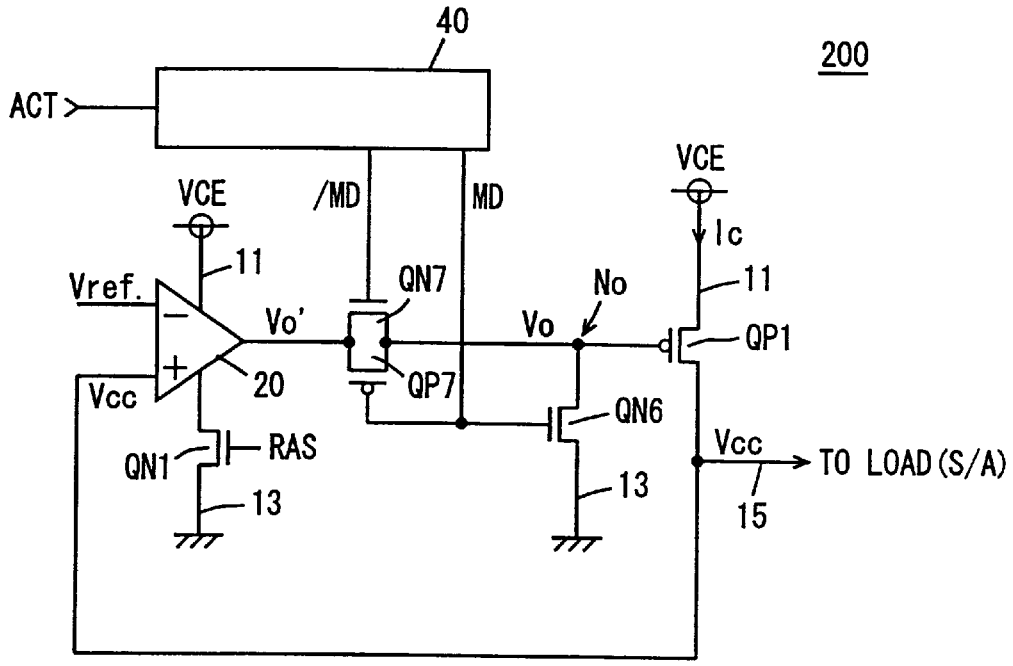
FIG. 6 is a circuit diagram of the specific configuration of internal power supply voltage generation circuit 200.

FIG. 6 is a circuit diagram of the specific configuration of internal power supply voltage generation circuit 200.

In FIG. 6, the specific configuration and controlling method of switches 51 and 52 are shown.

Referring to FIG. 6, internal power supply voltage generation circuit 200 includes transistors QN7 and QP7 corresponding to switch 51 in FIG. 5, a mode change signal generation circuit 40 to generate control signals MD, /MD for controlling transistor QP7, and transistors QN7 and QP7.

Herein, the configuration of mode change generation circuit 40 and the activation timings and state of mode change signal MD and the inverse thereof /MD are the same as those described in conjunction with FIG. 4 and therefore the description will not be repeated. More specifically, the activation timing and activation period of the mode change signals can be adjusted by mode change signal generation circuit 40, and the signal may be used to control turning on/off of the current supply transistor, so that desired control characteristics can be achieved.

Transistor QN7 receives signal /MD at its gate and connects voltage comparing circuit 20 and control node No. Similarly, transistor QP7 receives mode change signal MD at its gate and connects voltage comparing circuit 20 and control node No.

The gate of N-type transistor QN6 to connect internal node No and ground line 13 is provided with mode change signal /MD and functions similarly to switch 52 in FIG. 5 as a result, and the pair of transistors QN7 and QP7 or transistor QN6 are selectively turned on.

More specifically, when mode change signal MD is in an inactive state ("L" level), transistors QN7 and QP7 are turned on, control node No and voltage comparing circuit 20 are connected while transistor QN6 is turned off, and therefore voltage Vo at the control node becomes equal to voltage Vo' to be output from voltage comparing circuit 20 as a result of actually comparing the internal power supply voltage and the reference voltage.

Meanwhile, when mode change signal MD is in an active state ("H" level), control node No is connected to ground line 13 by the conduction of transistor QN6, and in this timing, transistors QN7 and QP7 are turned off.

Thus, the output node of voltage comparing circuit 20 and control node No are disconnected, and voltage Vo at the control node is quickly changed to the level of ground voltage Vss. Conversely, if current supply transistor PQ1 is turned on by pulling voltage Vo at the control node to the level of Vss by turning on transistor QN6 with voltage comparing circuit 20 and control node No without providing transistors QN7 and QP7, the following problem is encountered.

The output voltage of voltage comparing circuit 20 immediately before the operation of the load is generally at the level of a voltage corresponding an "H" level to turn off P-type transistor QP1, and it takes a prescribed period of time for the voltage at the control node to be lowered if transistor QN6 is forcibly turned on, and therefore, the conduction timing of current supply transistor QP1 is delayed by that time period.

Since the output voltage of voltage comparing circuit 20 immediately before the operation of the load cannot be specified, and the delay in the timing is not constant, it is difficult to adjust the operation timing of the load and the on-timing of the current supply transistor.

Furthermore, output voltage Vo' is maintained at a prescribed value as long as internal power supply voltage Vcc is actually not lower than reference voltage Vref, current is passed through transistor QN6 from the output node of the voltage comparing circuit to ground line 13 and wasted. Furthermore, voltage Vo at the control node might not be able to be fully lowered to the level of Vss and the current supplying capability can be lower than a desired level as a result.

Accordingly, there are provided a transistor to forcibly connect control node No to ground line 13 in the same operation timing as the load, and a transistor to disconnect control node No and voltage comparing circuit 20 in order to avoid the above described problem so that the operation start timing of the load and the on-timing of current supply transistor QP1 are easily matched, and that power supply current Ic is sufficiently supplied to stably control internal power supply voltage Vcc.

Third Embodiment

In a third embodiment, a current is supplied to internal power supply line 15 in the operation timing of the load similarly to the second embodiment, and the power supply of voltage comparing circuit 20 is disconnected in the period in which the voltage comparing operation is not necessary to further reduce the power consumption.

Figure 7:
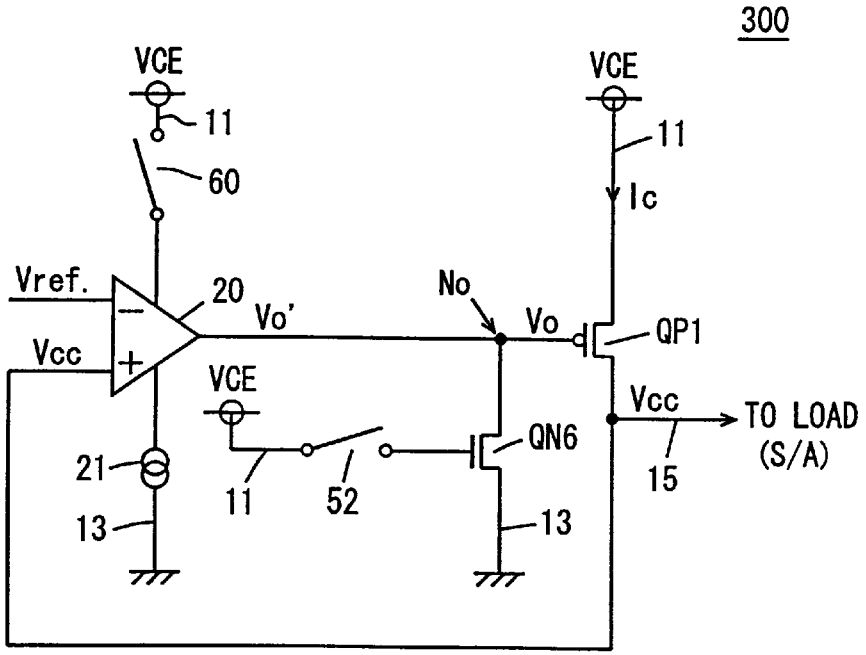
FIG. 7 is a schematic block diagram for use in illustration of an internal power supply voltage generation circuit 300 according to a third embodiment of the present invention.

FIG. 7 is a schematic block diagram of the general configuration of an internal power supply voltage generation circuit 300 according to the third embodiment of the present invention.

Referring to FIG. 7, internal power supply voltage generation circuit 300 is different from internal power supply voltage generation circuit 200 shown in FIG. 5 in that switch 51 to connect voltage comparing circuit 20 and control node No is not provided, and that a switch 60 is provided instead between external power supply line 11 and voltage comparing circuit 20.

Switches 52 and 60 are selectively turned on/off similarly to the second embodiment.

In FIG. 7, switch 60 to control power supply to voltage comparing circuit 20 is provided on the side of external power supply line rather than on the side of the ground line for the following reason.

Figure 8:
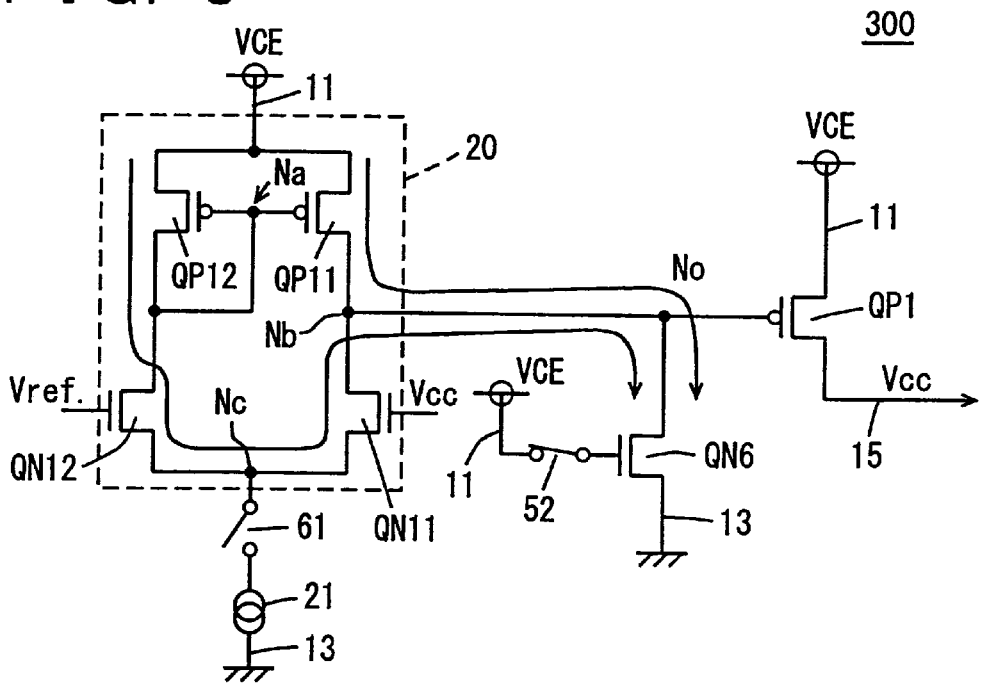
FIG. 8 is a circuit diagram for use in illustration of a problem encountered when a power supply switch 60 is provided on the side of a ground line.

FIG. 8 is a circuit diagram for use in illustration of a problem occurring when the power supply switch for the voltage comparing circuit is provided on the ground line side.

Referring to FIG. 8, voltage comparing circuit 20 in dotted line is typically formed by a current mirror amplifier and includes 2 P-type transistors QP11 and QP12 having gates connected to an internal node Na. Transistor QP11 connects external power supply line 11 and the output node Nb of voltage comparing circuit 20. Transistor QP12 connects external power supply line 11 and internal node Na.

Voltage comparing circuit 20 further includes an N-type transistor QN11 connected between nodes Nb and Nc to receive internal power supply voltage Vcc at its gate and an N-type transistors QN12 connected between nodes Na and Nc to receive voltage Vref at its gate. A voltage corresponding to the difference between voltages applied to the gates of N-type transistors QN11 and QN12 is generated at output node Nb. In FIG. 8, voltage comparing circuit 20 is connected to ground line 13 through a constant current source 21 by switch 61, and Power supply is provided to voltage comparing circuit 20.

Let us now assume that one of switches 52 and 61 is turned on and the other is turned off in this circuit.

In this case, node No is forcibly connected to ground line 13 to turn on current supply transistor QP1 using voltage Vo at the control node as ground voltage Vss. If, however, switch 61 is turned off, current continues to be flowed in the path of external power supply line 11—transistor QP11—node Nb—node No—transistor QN6—ground line 13 and the path of external power supply line 11—transistor QP12—node Na—transistor QN12—node Nc—transistor QN11—node Nb—node No—transistor QN6—ground line 13, between external power supply line 11 and ground line 13. Thus, voltage at control node No might not be able to be fully lowered to the level of Vss and power can be wasted.

Meanwhile, if power supply switch 60 to voltage comparing circuit 20 is provided on the side of external power supply line 11 as shown in FIG. 7, external power supply line 11 and transistors QP11 and QP12 are disconnected, and the current paths as described in conjunction with FIG. 8 are eliminated, thus eliminating the above described problem.

Figure 9:
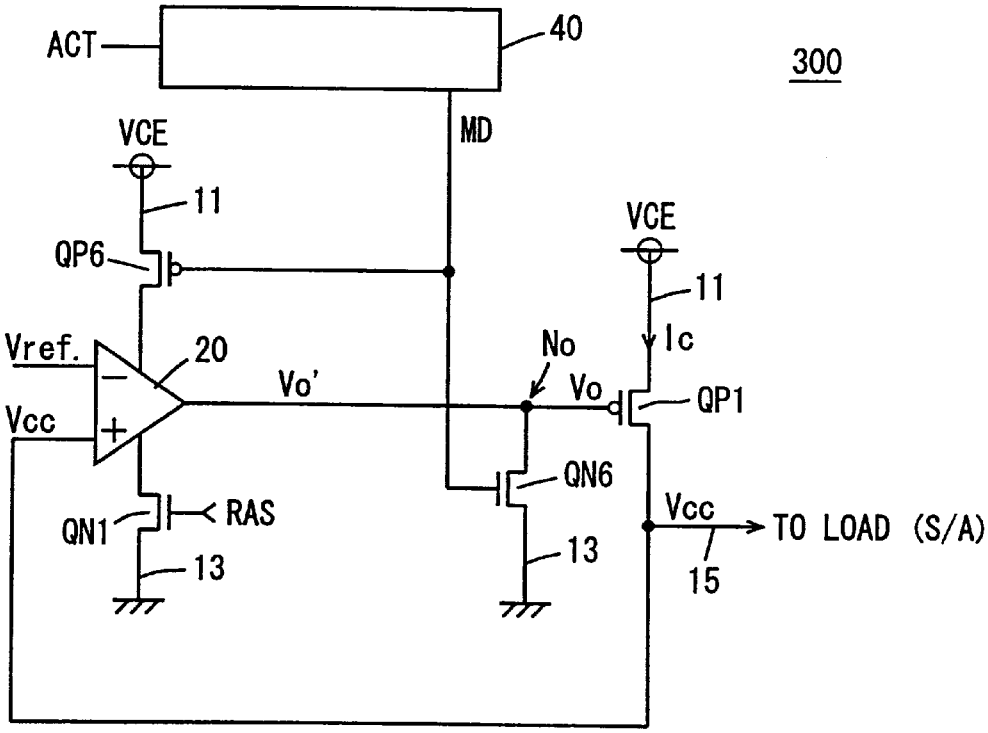
FIG. 9 is a circuit diagram of the specific configuration of internal power supply voltage generation circuit 300.

FIG. 9 is a circuit diagram of the specific configuration of internal power supply voltage generation circuit 300.

Referring to FIG. 9, internal power supply voltage generation circuit 300 further includes a P-type transistor QP6 corresponding to switch 60 in FIG. 7 and a mode change signal generation circuit 40 to generate mode change signal MD to control transistor QP6.

Mode change signal generation circuit 40 has the same configuration and operates in the same manner as those in the first and second embodiments, and the description is not repeated.

In internal power supply voltage generation circuit 300, mode change signal MD is applied to the gates of transistors QP6 and QN6 among the output of mode change signal generation circuit 40. Thus, when mode change signal MD is activated (into an "H" level) in a period corresponding to the operation timing of the load, transistor QN6 is turned on to quickly turn on current supply transistor QP1, and transistor QP6 is turned off to interrupt supply of power to voltage comparing circuit 20, and power consumption is cut down.

Thus, in internal power supply voltage generation circuit 300, current supply transistor QP1 is forcibly turned on in the operation timing of the load to stably control internal power supply voltage Vcc, power consumption in this period is cut and the power consumption by the entire circuit can be reduced.

It is understood that employing an internal power supply voltage generation circuit having a combined configuration of the second and third embodiments permits the effects of both embodiments to be provided.

Fourth Embodiment

In the first to third embodiments of the present invention, a current supply transistor is forcibly turned on for a prescribed time period set by the delay circuit in the same timing in which current is consumed by the load in order to supply current from the external power supply line to the internal power supply line.

Power supply current Ic passed when the current supply transistor conducts depends on the voltage difference between external power supply voltage VCE and internal power supply voltage Vcc, and therefore the amount of charges supplied from the external power supply line in other words, the integral value of power supply current Ic changes depending upon the level of external power supply voltage VCE with the current supply transistor being conductive in a prescribed time period. Meanwhile, current consumed by the load operating within, in other words, the amount of charges is generally irrespective of the level of the external power supply voltage.

Therefore, according to the fourth embodiment, an internal power supply voltage generation circuit capable of constantly supplying a prescribed amount of charges to the load in various levels of external power supply voltage is provided.

Figure 10:
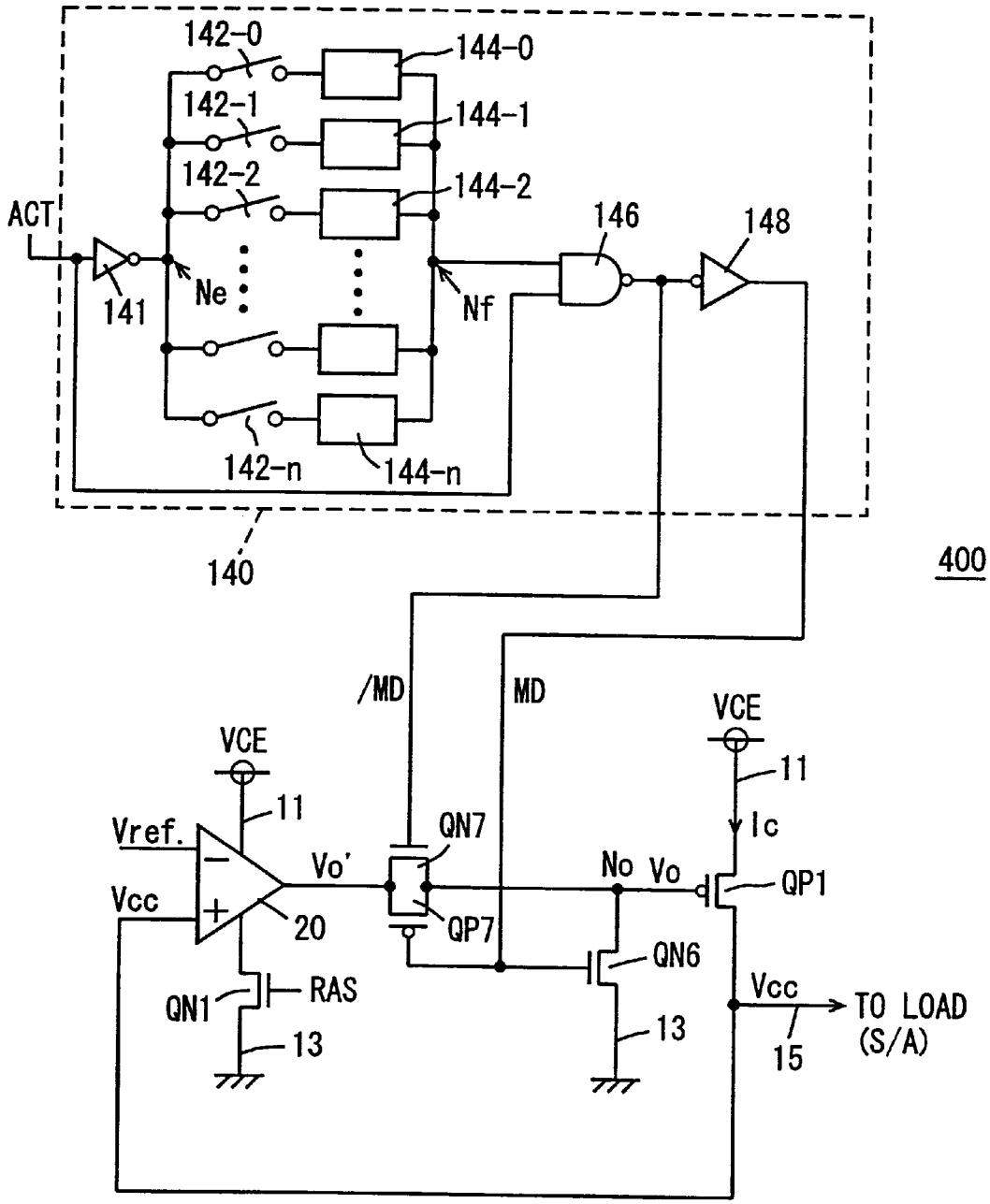
FIG. 10 is a schematic block diagram for use in illustration of the specific configuration of an internal power supply voltage generation circuit 400 according to a fourth embodiment of the invention.

FIG. 10 is a schematic block diagram for use in illustration of internal power supply voltage generation circuit 400 according to the fourth embodiment of the present invention.

Referring to FIG. 10, internal power supply voltage generation circuit 400 is different from internal power supply voltage generation circuit 200 shown in FIG. 6 in that the mode change signal generation circuit to generate mode change signal MD has a different configuration.

Since the other configuration and operation are the same as those of internal power supply voltage generation circuit 200 and therefore the description is not repeated.

Mode change signal generation 140 in internal power supply voltage generation circuit 400 receives load activation timing signal ACT and generates mode change signal MD and the inverse thereof /MD similarly to mode change signal generation 40 previously described, but has a different configuration.

Mode change signal generation circuit 140 includes an inverter 141 which receives and inverts signal ACT, a node Ne connected to the output node of inverter 141, a logic gate to output a NAND of internal node Nf and signal ACT, and an inverter 148 to invert the output of logic gate 146.

There are a plurality of pairs of switches and delay circuits connected in parallel between internal nodes Ne and Nf.

Delay circuits 144-0 to 144-n have different delay time and are connected between internal nodes Ne and Nf in response to turning on of a corresponding switch (n: natural number). By selectively turning on one of switches 142-0 to 142-n, the activation period of mode change signal MD can be selectively determined among n+1 kinds of delay time.

More specifically, in internal power supply voltage generation circuit 400, if the level of external power supply voltage VCE is known, the conduction period of the current supply transistor, in other words, the active period of the mode change signal can be adjusted based on the relation between current flow Ic determined by the level of voltage VCE and the amount of charges consumed by the load. Thus, at various external power supply voltages VCE, the amount of charges supplied from external power supply line 11 to internal power supply line 15 can be adjusted to be constant.

Figure 11:
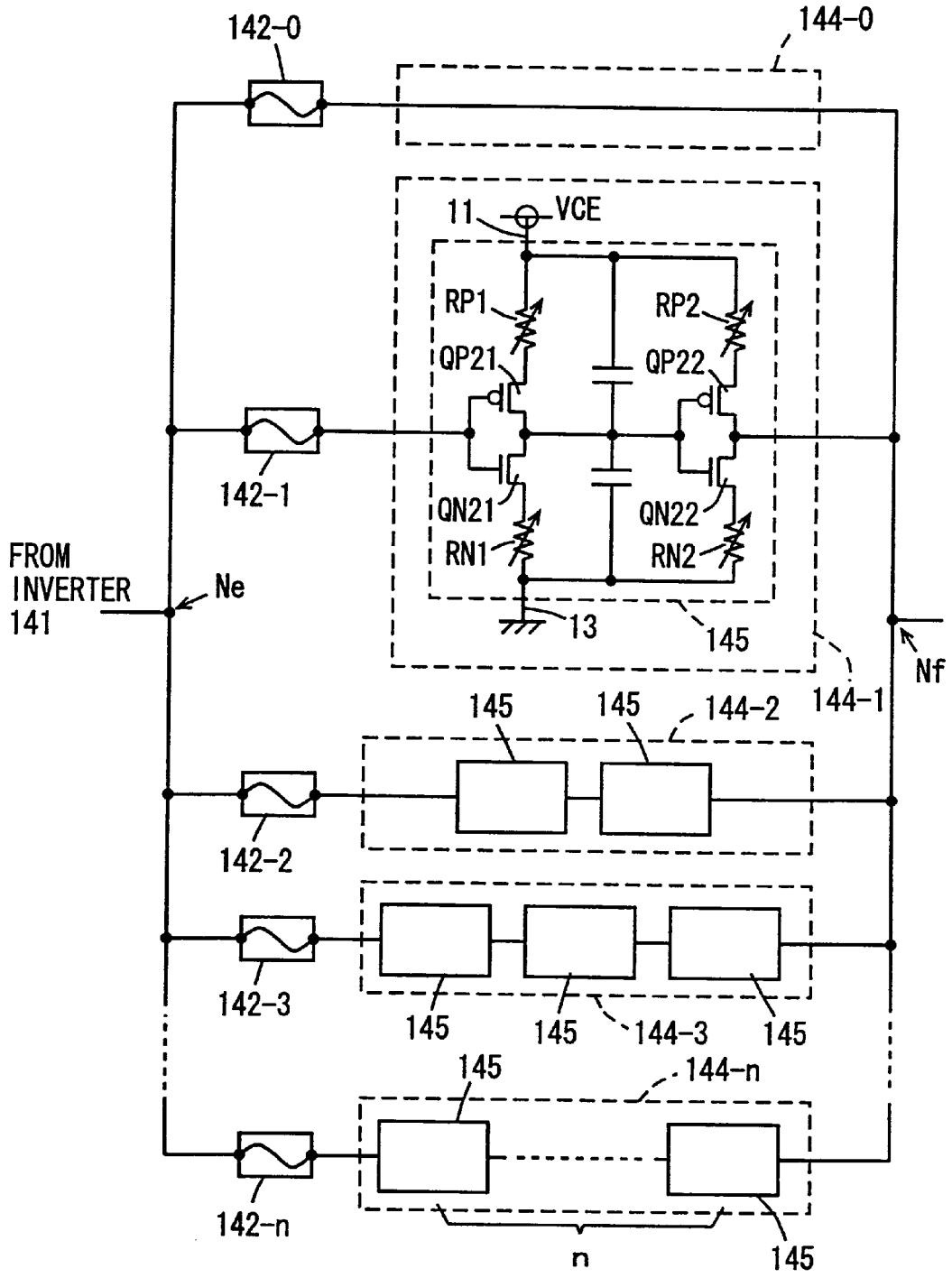
FIG. 11 is a circuit diagram for use in illustration of the specific configuration of a mode change signal generation circuit 140.

FIG. 11 is a circuit diagram for use in illustration of the specific configuration of mode change signal generation circuit 140. FIG. 11 mainly shows the configuration of n+1 delay circuits arranged in parallel and having delay time different from one another.

Referring to FIG. 11, delay circuits 144-0 to 144-n are connected in parallel with one another. Delay circuit 144-1 will be now described by way of illustration.

Delay circuit 144-1 includes a single unit delay circuit 145. Unit delay circuit 145 includes an inverter formed by transistors QP21 and QN21 and an inverter formed by transistors QP22 and QN22. Using these two inverters connected in series, a signal input to unit delay circuit 145 is delayed by unit time delay tu for output.

These inverters are supplied with external power supply voltage VCE for operation. Thus, unit delay time tu changes depending on the level of external power supply voltage VCE. More specifically, the driving if current of the inverters is larger when the level of VCE is larger, and therefore unit delay time tu can be set shorter. This agrees with the direction in which the adjustment is intended, and the adjustment can be more easily performed by employing the external power supply voltage or voltage depending on the external power supply voltage as the driving voltage supplied by the inverters.

Delay circuit 140-2 includes two unit delay circuits 145 connected in series. Thus, delay circuit 144-2 delays an input signal by time delay 2·tu for output. Similarly unit delay circuit 140-3 includes three unit delay circuits connected in series to delay an input signal by 3·tu for output.

The i-th delay circuit 144-i (i: natural number from 0; to n) among n delay circuits in total includes i unit delay circuits 145 to delay an input signal by i·tu for output.

Fuses 142-0 to 142-n are provided corresponding to delay circuits 144-0 to 144-n, respectively. One delay circuit is selectively connected between internal nodes Ne and Nf by selecting among these fuses. As previously described, the activation period of mode change signal MD generated in response to load activation timing signal ACT is equal to delay time provided by a delay circuit, and therefore the activation period of mode change signal MD, in other words, the forcible conduction period of the current supply transistor can be determined based on which to select among the n+1 delay circuits.

First Modification of Fourth Embodiment

Figure 12:
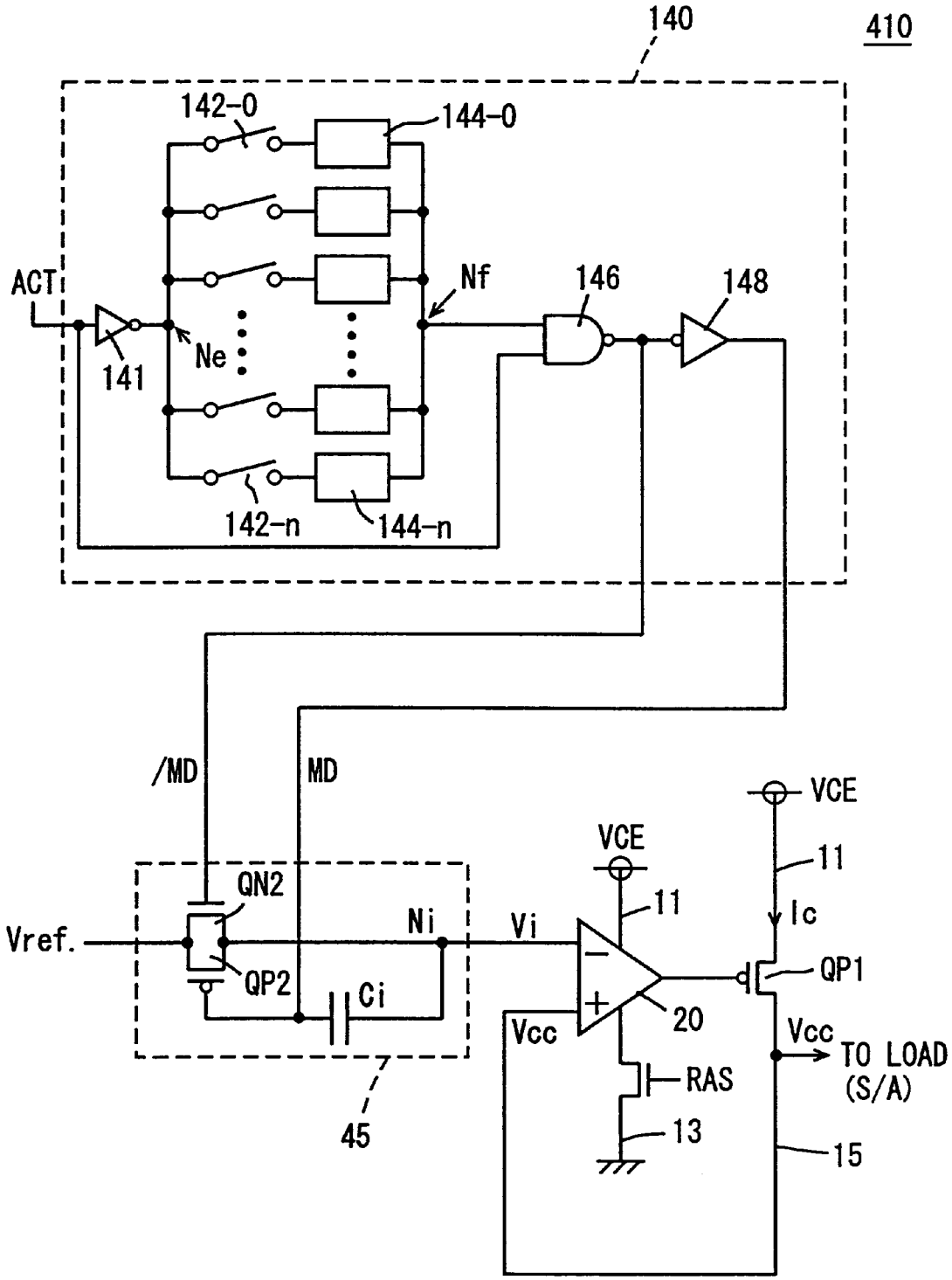
FIG. 12 is a schematic block diagram of the configuration of an internal power supply voltage generation circuit 410 according to a first modification of the fourth embodiment.

FIG. 12 is a schematic block diagram of the configuration of an internal power supply voltage generation circuit 410 according to a first modification of the fourth embodiment.

Referring to FIG. 12, an internal power supply voltage generation circuit 410 is different from internal power supply voltage generation circuit 100 described in conjunction with FIG. 2 in that a mode change signal generation circuit 140 is provided instead of mode change signal generation circuit 40 as a circuit to generate mode change signal MD and the inverse thereof /MD. The other configuration and corresponding operation in response to mode change signals MD and /MD are the same as those previously described and the description will not be repeated.

The configuration and operation of mode change signal generation circuit 140 are the same as those of internal power supply voltage generation circuit 400 according to the fourth embodiment.

Internal power supply voltage generation circuit 410 uses mode change signal generation circuit 140 which can adjust the activation period of mode change signals MD and /MD by selecting among a plurality of delay circuits connected in parallel and having different delay time, and therefore in addition to the effects brought about by internal power supply voltage generation circuit 100 according to the first embodiment, even in various levels of external power supply voltage VCE, the amount of charges supplied from external power supply line 11 in the forcible conduction period of the current supply transistor can be kept at a constant level.

Second Modification of Fourth Embodiment

Figure 13:
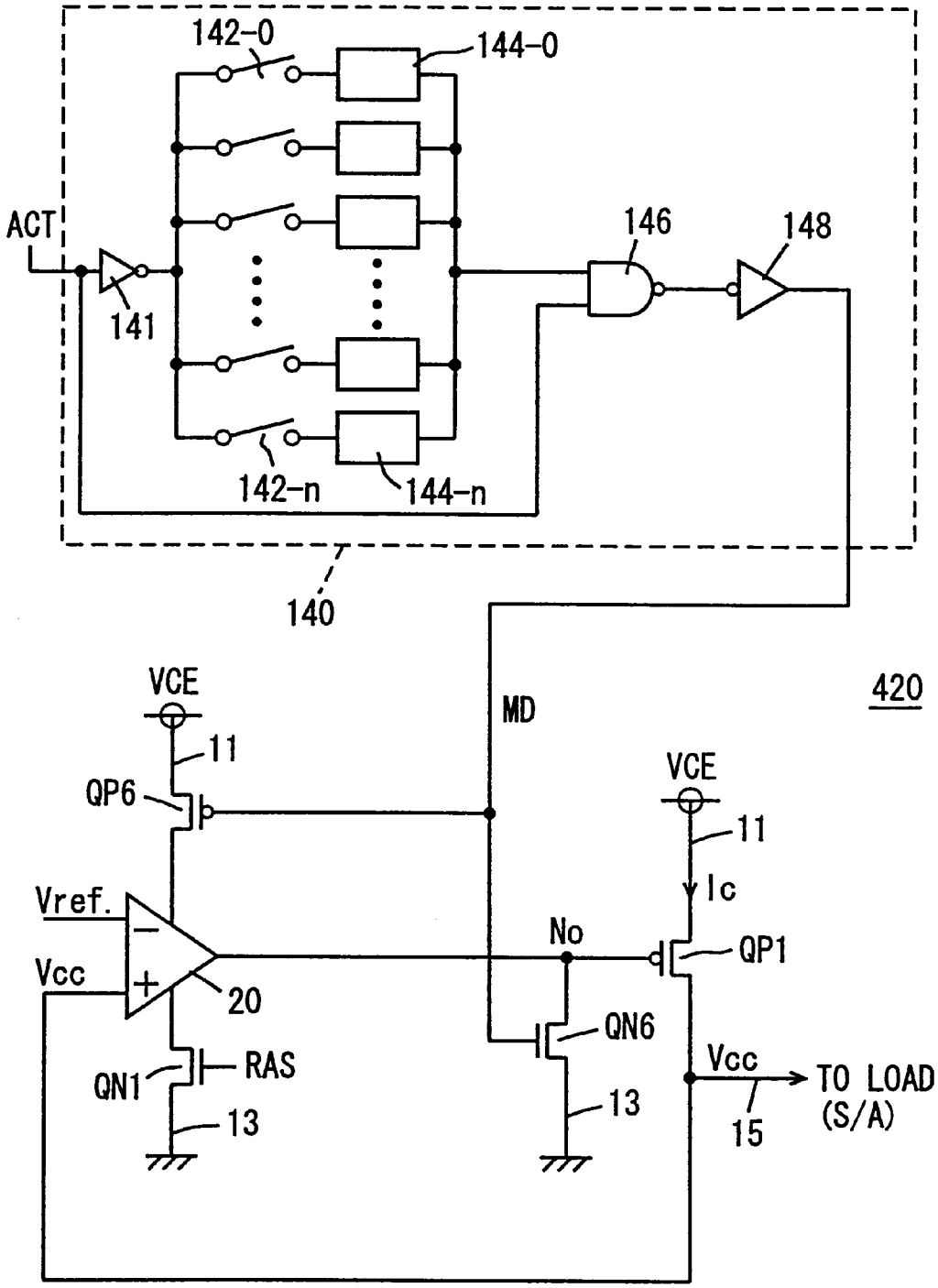
FIG. 13 is a schematic block diagram of the configuration of an internal power supply voltage generation circuit 420 according to a second modification of the fourth embodiment.

FIG. 13 is a schematic diagram of the configuration of an internal power supply voltage generation circuit 420 according to a second modification of the fourth embodiment of the present invention.

Referring to FIG. 13, internal power supply voltage generation circuit 420 has the same configuration as internal power supply voltage generation circuit 300 described in conjunction with FIG. 9 except for mode change signal generation circuit 140 to generate mode change signal MD. The configuration and operation of mode change signal generation circuit 140 are the same as those of internal power supply voltage generation circuit 400 according to the fourth embodiment.

More specifically, internal power supply voltage generation circuit 420 can generate mode change signal /MD by mode change signal generation circuit 140 capable of adjusting the activation period, control the length of conduction period of transistors QP6 and QN6 based on this signal /MD, and provide the effects as those according to the third and fourth embodiments.

Fifth Embodiment

In a fifth embodiment, in order to eliminate the dependency of the amount of charges in the forcible conduction period of the current supply transistor according to the fourth embodiment on the level of external power supply voltage VCE, the conduction of the current supply transistor is controlled using a high frequency pulse signal.

Figure 14:
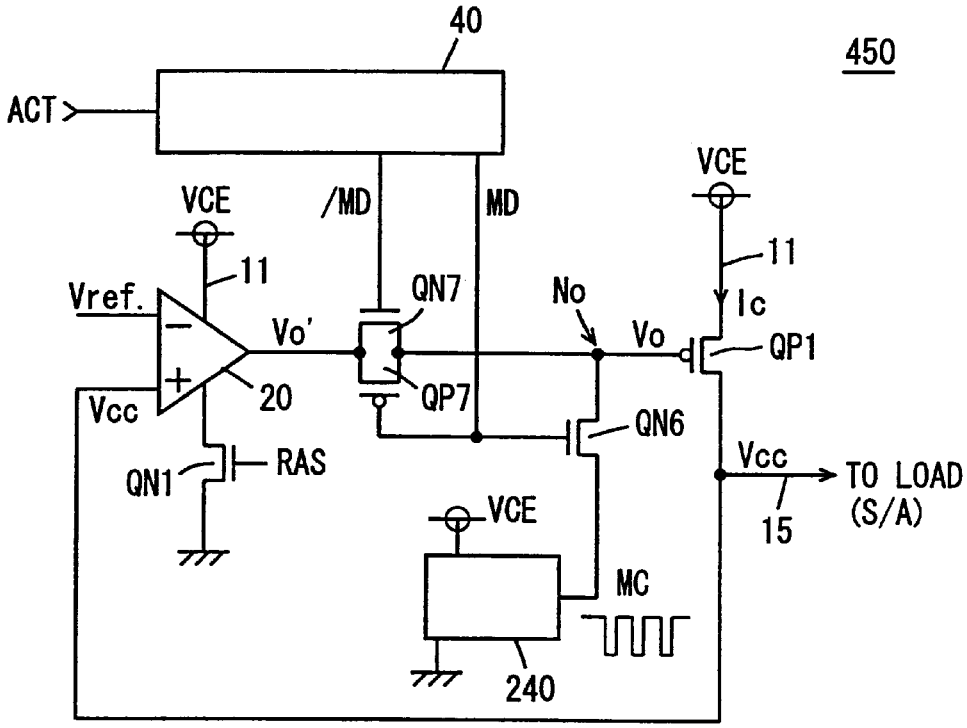
FIG. 14 is a schematic block diagram of the configuration of an internal power supply voltage generation circuit 450 according to a fifth embodiment of the present invention.

FIG. 14 is a schematic block diagram of the configuration of internal power supply voltage generation circuit 450 according to a fifth embodiment of the present invention.

Referring to FIG. 14, internal power supply voltage generation circuit 450 is different from internal power supply voltage generation circuit 200 described in conjunction with FIG. 6 in that the source of transistor QN6 to forcibly changed the voltage of control node No connected to the gate of the current supply transistor is connected to control pulse signal generating circuit 240 rather than to ground line 13. The other configuration and operation are the same as those of internal power supply voltage generation circuit 200, and the description is not repeated.

Control pulse signal generating circuit 240 generates a control pulse signal MC, a pulse signal having a plurality of active states ("L" level: ground voltage Vss) and inactive states ("H" level) repeated during the active period of control signal MD.

Figure 15:
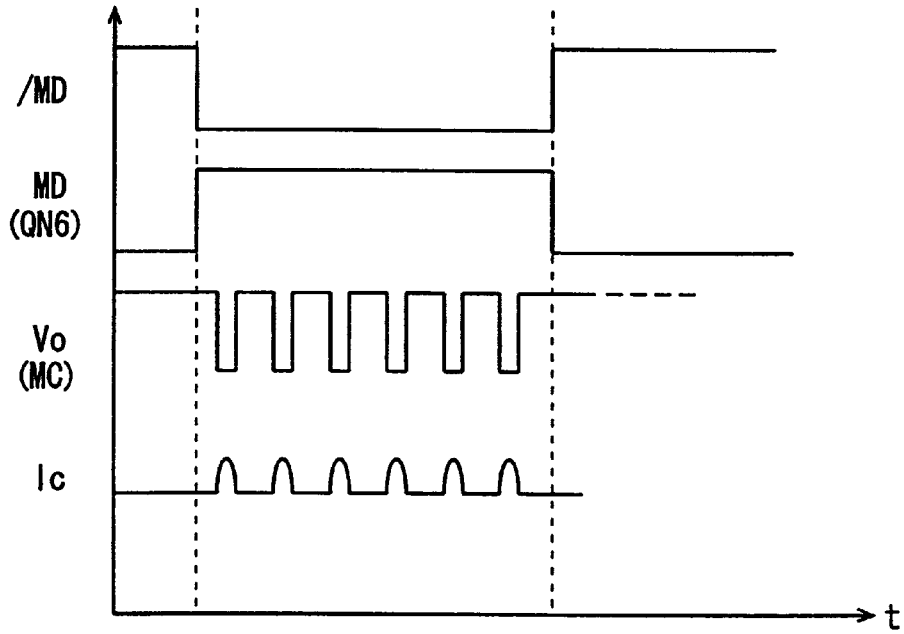
FIG. 15 is an operation waveform chart for use in illustration of the operation of internal power supply voltage generation circuit 450.

FIG. 15 is an operation waveform chart for use in illustration of the operation of internal power supply voltage generation circuit 450.

As previously described, transistors QN7 and QP7 are turned off in a prescribed active period by mode change signal MD and signal /MD, transistor QN6 is turned on simultaneously with the disconnection of the output voltage comparing circuit 20 and control node No, and control node No and control pulse signal generating circuit 240 are connected. Thus, control pulse signal MC is transmitted to control node No and the voltage Vo of the control node changes pulse-wise as a result.

When control signal MC is in an inactive state (in ground voltage Vss level), current supply transistor QP1 is turned on, and power supply current Ic is supplied from external power supply line 11 to internal power supply line 15. In an active period of mode change signal MD, current supply transistor QP1 is repeatedly turned on/off based on the state of signal MC.

Thus, the total on-time of current supply transistor QP1 in the active period of mode change signal MD changes according to the time ratio of the active and inactive periods of control pulse signal MC.

More specifically, internal power supply voltage generation circuit 450 changes the time ratio of the active and inactive periods depending on the level of external power supply voltage VCE with the pulse number of control pulse signal MC being constant during the active period of mode change signal MD to cancel changes in power supply current Ic depending on the level of external power supply voltage VCE and adjusts the amount of charges supplied in the active period of the mode change signal at a constant level independent of the level of external power supply voltage VCE.

Figure 16:
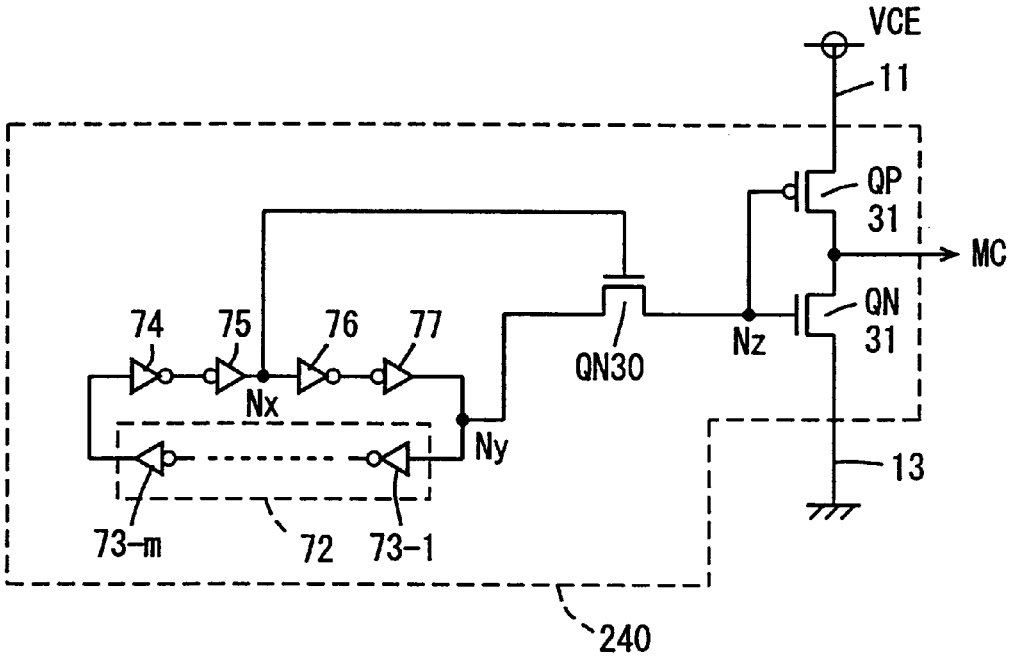
FIG. 16 is a circuit diagram of the specific configuration of control pulse signal generating circuit 240.

FIG. 16 is a circuit diagram of the specific configuration of control pulse signal generating circuit 240.

Referring to FIG. 16, control pulse signal generating circuit 240 includes a ring oscillator circuit 72, an inverter 74 to invert the output of ring oscillator circuit 72, an inverter 75 to invert the output of inverter 74 for output to a node Nx, an inverter 76 to invert the state of node Nx for output and an inverter 77 to invert the output of inverter 76 for output to a node Ny. Control pulse signal generating circuit 240 further includes an N-type transistor QN30 having a gate connected to node Nx and connecting nodes Ny and Nx, P-type transistor QP31 and N-type transistor QN31 having a gate connected to node Nz and connected in series with each other between external power supply line 11 and ground line 13. Control pulse signal MC is generated at the drains of transistors QP31 and QN31 connected with each other.

Ring oscillator circuit 72 has a plurality of (odd) inverters and generates a rectangular pulse signal at a prescribed frequency.

The operation of control pulse signal generating circuit 240 will be described by referring to a timing chart.

Figure 17:
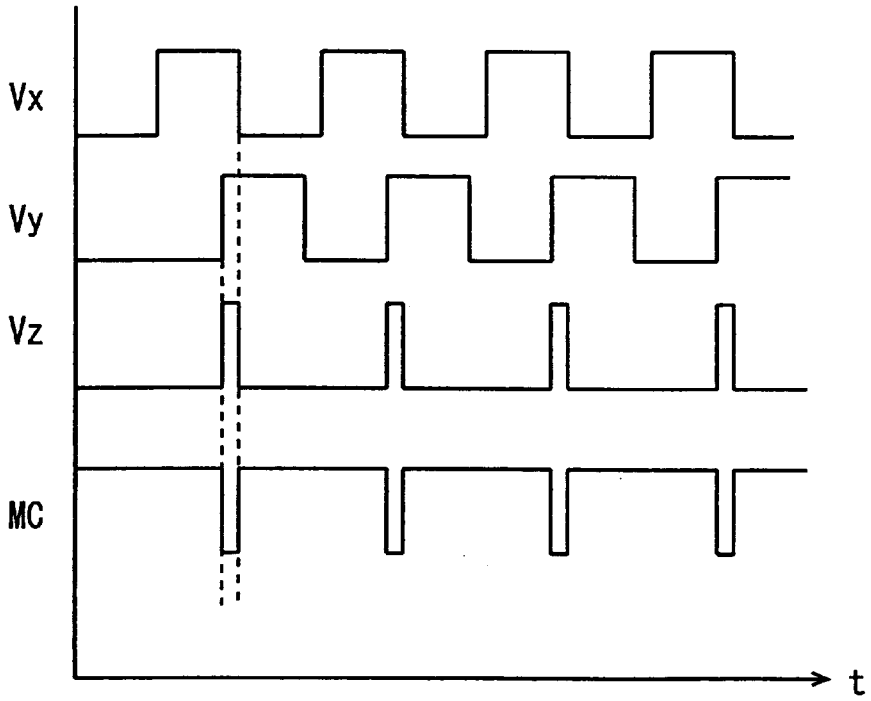
FIG. 17 is an operation waveform chart for use in illustration of the operation of control pulse signal generating circuit 240.

FIG. 17 is an operation waveform chart for use in illustration of the operation of control pulse signal generating circuit 240.

The pulse signal generated by ring oscillator circuit 72 is delayed by a train of inverters 74 to 77, and pulse voltage signals Vx and Vy in different phases result at nodes Nx and Ny. By connecting the gate and source of transistor QN3O to node Nx and Ny, respectively, a pulse voltage signal Vz corresponding to an AND of the states of node Nx and the state of node Ny is generated at node Nz connected to the drain of transistor QN30.

The phase delay of pulse voltage signal Vy relative to pulse voltage signal Vx corresponds to the delay time by inverters 76 and 77. Therefore, the pulse width ("H" level period) of pulse signal Vz as the result of AND of both decreases and increases as a function of the delay time by inverters 76 and 77.

In general, delay time in an inverter circuit is smaller for higher driving power supply voltage levels of the inverters, and therefore by driving these inverters which delay the output pulse signal of the ring oscillator circuit with external power supply voltage VCE, the pulse width of pulse voltage signal Vz can be changed according to the level of external power supply voltage VCE.

More specifically, when external power supply voltage VCE is higher, the "H" level period of pulse voltage signal Vz can be set shorter, and when external power supply voltage VCE is lower, the "H" level can be set longer.

The active period ("L" level) of control pulse signal MC is equal to the "H" level period of pulse voltage signal Vz, the active period of control pulse signal MC transmitted to the gate of current supply transistor QP1 is set shorter for higher external power supply voltage VCE. Meanwhile, the active state period of control pulse signal MC is set longer for lower external power supply voltage VCE.

Therefore, if the number of inverter stages in ring oscillator circuit 72 is adjusted so that the pulse number of pulse voltage signal Vz is constant, the total on-time of current supply transistor QP1 can be set shorter for increased external power supply voltage, and the total on-time of current transistor QP1 can be set longer for lower external power supply voltage VCE.

Thus, the amount of charges supplied by current supply transistor QP1 in the active period of the mode change signal can be adjusted at a constant value independent of the level of external power supply voltage VCE by canceling changes in power supply current Ic depending on the level of external power supply voltage VCE.

Furthermore, by adjusting the number of stages of inverters connected between nodes Nx and Ny, the total on-time of current supply transistor QP1 can be significantly changed, so that the level of the amount of charges supplied in the active period of the mode change signal can be adjusted.

The dependency of the delay time in the inverter circuit on the level of driving power supply voltage is generally more notable in the region of lower driving power supply voltage levels. Therefore, if the operation voltage is further lowered in the future, internal power supply voltage generation circuit 450 according to the fifth embodiment can effectively eliminate the dependency of the amount of supplied charges on external power supply voltage VCE.

Figure 18:
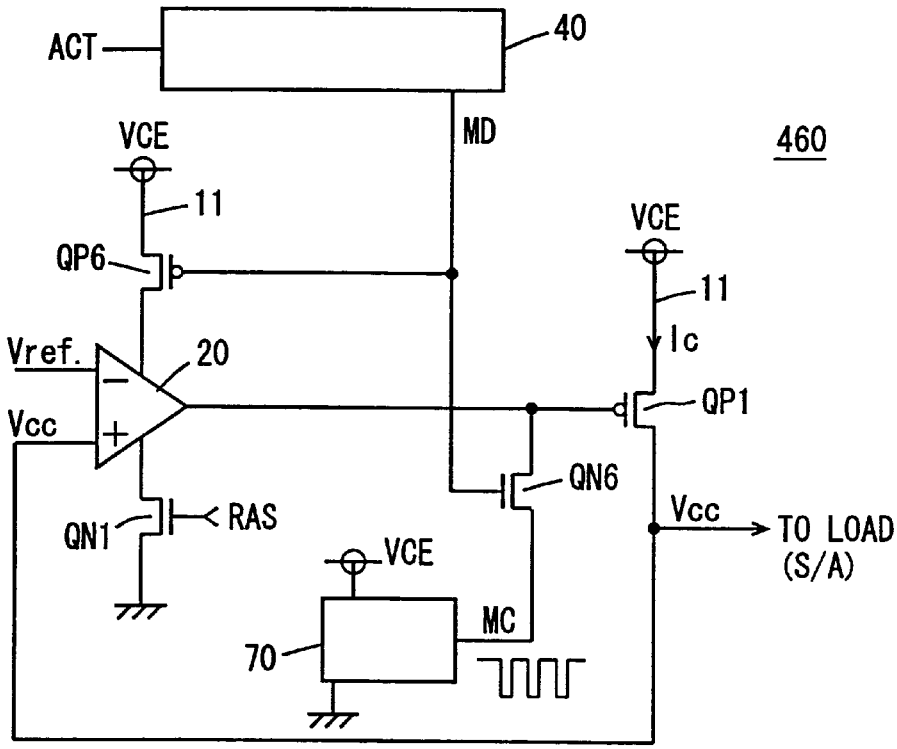
FIG. 18 is a schematic block diagram for use in illustration of the configuration of an internal power supply voltage generation circuit 460 according to a modification of the fifth embodiment.
Figure 19:
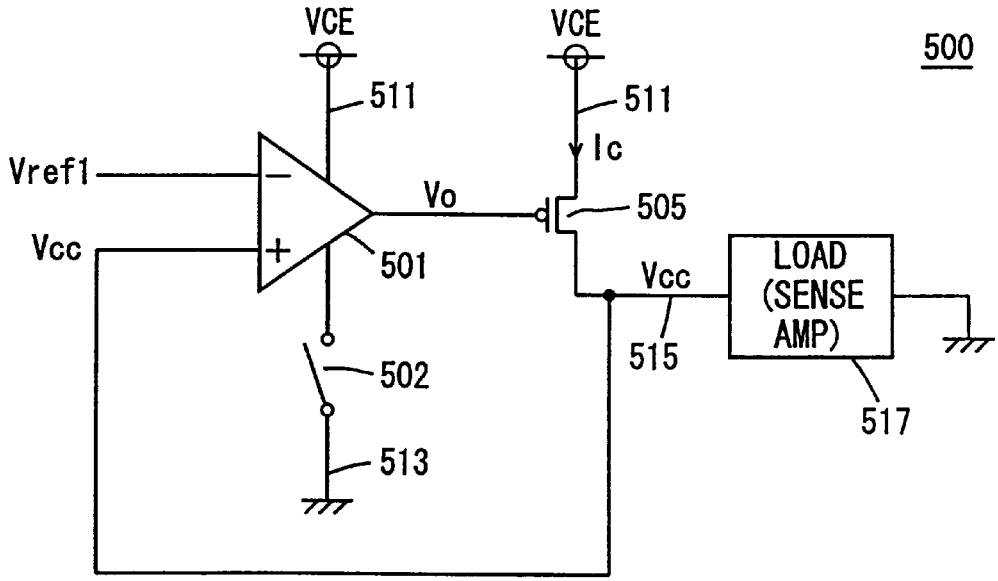
FIG. 19 PRIOR ART
FIG. 19 is a schematic block diagram for use in illustration of the configuration of a conventional internal power supply voltage generation circuit 500.
Figure 20:
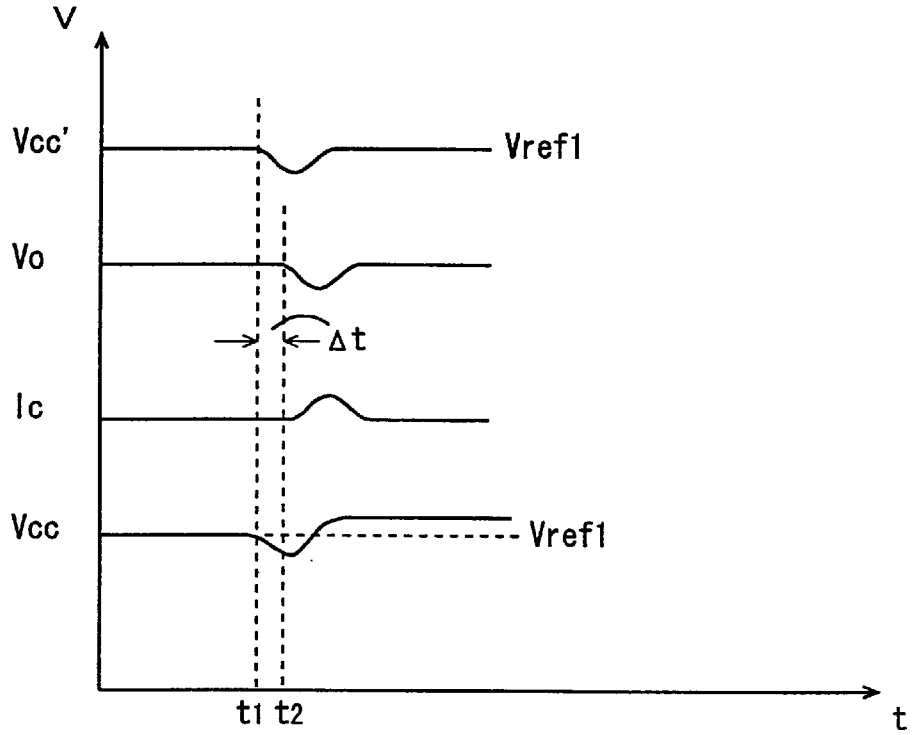
FIG. 20 PRIOR ART
FIG. 20 is a diagram for use in illustration of the concept of a problem associated with conventional internal power supply voltage generation circuit 500.
Figure 21:
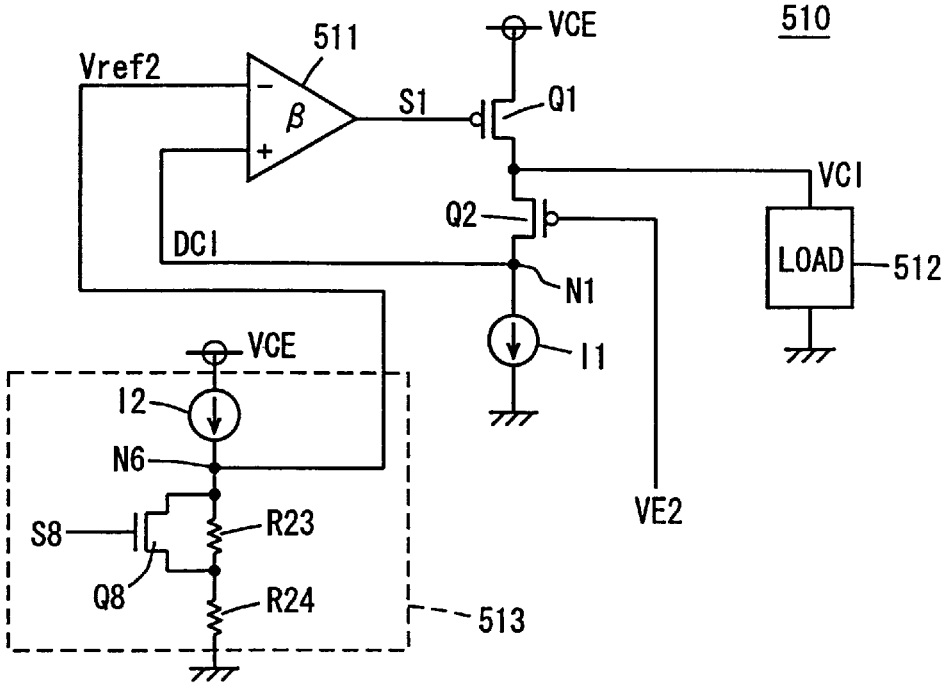
FIG. 21 PRIOR ART
FIG. 21 is a circuit diagram for use in illustration of the configuration of a conventional internal power supply voltage generation circuit 510.

Modification of Fifth Embodiment FIG. 18 is schematic block diagram of the configuration of an internal power supply voltage generation circuit 460 according to a modification of the fifth embodiment.

Referring to FIG. 18, internal power supply voltage generation circuit 460 is different in that transistor QN6 to forcibly change voltage at control node No connected to the gate of the current supply transistor is connected to control pulse signal generating circuit 240 rather than to ground line 13. The other configuration and operation are the same as those of internal power supply voltage generation circuit 300 and the description is not repeated.

Control pulse signal generating circuit 240 is the same as that according to the fifth embodiment and is not described.

More specifically, internal power supply voltage generation circuit 460 can adjust the amount of charges supplied to internal power supply line 15 during the conduction period of current supply transistor QP1 at a constant value independent of the level of external power supply voltage VCE and can bring about the effects provided by the fifth and third embodiments.

According to the embodiments of the present invention, sense amplifiers are described as a load included in a semiconductor memory device by way of illustration, but the present invention is not limited to application to a sense amplifier as a load. More specifically, the same effect can be brought about by generating a mode signal corresponding to a load whose operation timing and period are known.

The specific configuration of each circuit according to the first to fifth embodiments is described, but the present invention is not limited to these circuit configurations. It is understood that, for example, the current supply transistor or transistors used as various switches can be formed using transistors having different polarities in consideration of the polarities of voltage signals applied to the gates and that any circuit is applicable as the circuits to generate control signals such as the mode change signals and reference signals as long as the circuit can generate similar control signals.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A voltage generation circuit to supply an operation power supply voltage to a load which starts an active period to consume current in response to a control signal, comprising:

a first power supply line supplying said operation power supply voltage to the load;

a second power supply line supplied with a second voltage higher than a first voltage which provides a control target level for said operation power supply voltage;

a reference voltage signal generation circuit responsive to said control signal to set the level of a reference voltage signal to be higher than said first voltage in said active period of the load, and to set the level of said reference voltage signal to be at the level of said first voltage in an inactive period of said load;

a voltage comparing circuit comparing the voltage levels of said reference voltage signal and said first power supply line, and outputting a comparing result signal; and a current supply circuit to supply current from said second power supply line to said first power supply line based on the level of said comparing result signal.

2. The voltage generation circuit according to claim 1, wherein said reference voltage signal generation circuit comprises:

a mode change signal generation circuit generating a mode change signal which transits to an active state prior to the start of said active period of said load, maintains said active state for a prescribed time period and then transits to an inactive state, and a reference voltage signal boosting circuit setting the voltage level of said reference voltage signal to the level of said first voltage when said mode change signal is in said inactive state and to the voltage level produced by boosting the reference voltage signal when said mode change signal is in said active state.

3. The voltage generation circuit according to claim 2, further comprising a control target voltage line transmitting said first voltage, wherein said reference voltage signal boosting circuit comprises:

a first node generating said reference voltage signal;

a second node to which said mode change signal is transmitted;

a switch circuit disconnecting between said control target voltage line and said first node when said mode change signal is in said active state and connecting between said control target voltage line and said first node when said mode change signal is in said inactive state; and a capacitor connected between said first node and second node.

4. The voltage generation circuit according to claim 2, wherein said prescribed time period is set based on the level of said second voltage.

5. The voltage generation circuit according to claim 4, wherein said mode change signal generation circuit comprises:

an inverter inverting a control signal activated at the start of an activation period of said load for output;

a plurality of signal delay circuits having delay time different from one another set to delay an input signal by said set delay time;

a plurality of switches provided between the output node of said inverter and said plurality of signal delay circuits, respectively, one of said plurality of switches being selectively turned on; and an AND circuit using a node connected to each of said plurality of signal delay circuits and the input node of said inverter as two inputs and outputting said mode change signal.

6. The voltage generation circuit according to claim 1, wherein said reference voltage signal generation circuit includes a pulse generator including a plurality of delay circuits each having a delay time different from delay time of others, for generating a pulse with a predetermined period associated with the delay time of selected one of said plurality of delay circuits in response to a transition of the control signal, and a booster for boosting the reference voltage signal in response to the pulse.

7. A voltage generation circuit to supply an operation power supply voltage to a load which starts an active period to consume current in response to a control signal, comprising:

a first power supply line supplying said operation power supply voltage to the load;

a second power supply line supplied with a second voltage higher than a first voltage which provides a control target level for said operation power supply voltage;

a voltage comparing circuit to comparing the voltage levels of said first voltage and said first power supply line and outputting a comparing result signal;

a control node;

a current supply circuit operating in response to the voltage level of said control node to supply current from said second power supply line to said first power supply line; and a switch control circuit connecting said control node and said voltage comparing circuit in an inactive period of said load, disconnecting said control node and said voltage comparing circuit in said active period of said load and transmitting to said control node a third voltage which permits said current supply circuit to operate.

8. The voltage generation circuit according to claim 7, further comprising:

a mode change signal generation circuit generating a mode change signal which transits to an active sate prior to the start of said active period of said load, maintains said active state for a prescribed time period and then transits to an inactive state; and a third power supply line supplying said third voltage, wherein said switch control circuit comprises:

a first transistor provided to electrically connect said control node and said third power supply line and receiving said mode change signal at its gate; and a second transistor provided to electrically connect said voltage comparing circuit and said control node and receiving said mode change signal at its gate.

9. The voltage generation circuit according to claim 8, wherein said current supply circuit comprises a P-channel MOS transistor provided to electrically connect said first power supply line and said second power supply line and having a gate connected to said control node, said third power supply line transmitting a ground voltage.

10. The voltage generation circuit according to claim 8, wherein said prescribed time period is set based on the level of said second voltage.

11. The voltage generation circuit according to claim 8, further comprising a control pulse signal generating circuit connected between said first transistor and said third power supply line to output to said control node a control pulse signal having first and second states repeated a plurality of times during said prescribed time period, wherein the voltage level of said first state is equal to that of said third voltage and the voltage level of said second state being set based on the level of said second voltage, and said control pulse signal generating circuit sets a ratio of a period of said first state to a period of said second state based on the level of said second voltage.

12. The voltage generation circuit according to claim 11, wherein said control pulse signal generating circuit comprises:

a ring oscillator circuit generating a clock signal;

an assistant delay circuit delaying the output of said ring oscillator circuit and generate a delayed clock signal;

a first assistant transistor provided to electrically connect said assistant delay circuit and an intermediate node and receiving said clock signal at its gate;

a signal output node outputting said control pulse signal;

a second assistant transistor provided to electrically connect said second power supply line and said signal output node and having a gate connected to said intermediate node; and a third assistant transistor provided to electrically connect said third power supply line and said signal output node and having a gate connected to said intermediate node and a polarity different from said second assistant transistor.

13. A voltage generation circuit to supply an operation power supply voltage to a load which starts an active period to consume current in response to a control signal, comprising:

a first power supply line supplying said operation power supply voltage to the load;

a second power supply line supplied with a second voltage higher than a first voltage which provides a control target level for said operation power supply voltage;

a control node;

a voltage comparing circuit receiving supplied with an operation voltage from said second power supply line to compare the voltage levels of said first voltage and said first power supply line and outputting a comparing result signal to said control node;

a current supply circuit operating in response to a voltage at said control node to supply current from said second power supply line to said first power supply line;

a third power supply line supplying a prescribed voltage which permits said current supply circuit to operate when said prescribed voltage is applied to said control node;

a first switch circuit connecting said control node and said third power supply line in said active period of said load; and a second switch circuit provided between said second power supply line and said voltage comparing circuit to disconnect said second power supply line and said voltage comparing circuit in said active period of said load ,said operation voltage being supplied from said second power supply line via said second switch circuit.

14. The voltage generation circuit according to claim 13, further comprising a mode change signal generation circuit generating a mode change signal which transits to an active state prior to the start of said active period of said load, maintains said active state for a prescribed time period, and then transits to an inactive state, wherein said first switch circuit comprises a first transistor provided to electrically connect said control node and said third power supply line and receiving said mode change signal at its gate, said second switch circuit comprises a second transistor provided to electrically connect said second power supply line and said voltage comparing circuit and receiving said mode change signal at its gate.

15. The voltage generation circuit according to claim 14, wherein said current supply circuit comprises a P-channel MOS transistor provided to electrically connect said first power supply line and said second power supply line and having a gate connected to said control node, said third power supply line transmitting a ground voltage.

16. The voltage generation circuit according to claim 14, wherein said prescribed time period is set based on the level of said second voltage.

17. The voltage generation circuit according to claim 14, further comprising an control pulse signal generating circuit connected between said first transistor and said third power supply line to output to said control node a control pulse signal, said control pulse signal having first and second states repeated a plurality of times during said prescribed time period, wherein the voltage level of said first state is equal to that of said prescribed voltage and the voltage level of said second state being set based on the level of said second voltage, and said control pulse signal generating circuit sets a ratio of a period of said first state to a period of said second state based on the level of said second voltage.

18. The voltage generation circuit according to claim 17, wherein said control pulse signal generating circuit comprises:

a ring oscillator circuit generating a clock signal;

an assistant delay circuit delaying the output of said ring oscillator circuit and generating a delayed clock signal;

first assistant transistor provided to electrically connect said assistant delay circuit and an intermediate node and receiving said clock signal at its gate;

a signal output node outputting said control pulse signal;

a second assistant transistor provided to electrically connect said second power supply line and said signal output node and having a gate connected to said intermediate node; and a third assistant transistor provided to electrically connect said third power supply line and said signal output node and having a gate connected to said intermediate node and a polarity different from said second assistant transistor.

* * * * *